US005547293A

United States Patent [19]

Koch et al.

[11] Patent Number: 5,547,293

[45] Date of Patent: Aug. 20, 1996

[54] LABEL PRINTER SUCH AS A PRINTER FOR PRINTING SELF-ADHESIVE LABELS

[75] Inventors: Ulf Koch, Eberbach; Peter Schneider, Neckargemünd, both of Germany

[73] Assignee: Esselte Meto International GmbH, Heppenheim, Germany

[21] Appl. No.: 310,615

[22] Filed: Sep. 22, 1994

[30] Foreign Application Priority Data

Sep. 24, 1993 [DE] Germany ..... 43 32 602.1

[51] Int. Cl.[6] ..... B41J 2/315

[52] U.S. Cl. ..... 400/120.17; 400/56; 101/288; 347/198

[58] Field of Search ..... 400/53, 56, 57, 400/120.17, 120.16, 58; 101/288; 347/8, 197, 198

[56] References Cited

U.S. PATENT DOCUMENTS

| | | | |
|---|---|---|---|
| 4,666,319 | 5/1987 | Hirosaki et al. | 101/288 X |
| 4,897,670 | 1/1990 | Hasegawa et al. | 400/56 X |
| 5,014,073 | 5/1991 | Sone et al. | 400/120.17 |
| 5,028,155 | 7/1991 | Sugiura et al. | 400/619 |
| 5,156,467 | 10/1992 | Kitahara et al. | 400/120.17 |

FOREIGN PATENT DOCUMENTS

| | | | |
|---|---|---|---|
| 4139891 | 6/1993 | Germany . | |
| 0284968 | 12/1991 | Japan | 400/120.17 |

*Primary Examiner*—Christopher A. Bennett
*Attorney, Agent, or Firm*—Thomas N. Ljungman

[57] ABSTRACT

A label printer for printing labels can typically have a pressure roller and a corresponding print head, which print head can have a support, a spring base plate, and a spring disposed between the support and the spring base plate to bias the print head into engagement with the pressure roller. The spring base plate can be rotationally mounted on a bearing shaft which is preferably parallel to the pressure roller, and the free end of the bearing shaft can be flattened over a portion of its length to form two parallel key surfaces for engaging with a locking element that adjusts the biasing force of the spring by engaging and positioning the spring base plate. The locking element has a keyhole-like opening, with a circular portion having a diameter which is approximately equal to the diameter of the free end of the bearing shaft, and a narrow portion having a width approximately equal to the distance between the key surfaces of the bearing shaft to thereby non-rotationally fix the locking element to the bearing shaft.

20 Claims, 7 Drawing Sheets

LABEL PRINTER SUCH AS A PRINTER FOR PRINTING SELF-ADHESIVE LABELS

BACKGROUND OF THE INVENTION

1. Field of the Invention

This invention generally relates to a label printer for printing labels, such as self-adhesive labels. Such a printer can have a pressure roller and, corresponding to the pressure roller, a print head which has printing elements for printing on the label material. The print head can be mounted on a support which can be biased towards the pressure roller to engage the pressure roller, by means of a compression spring mounted on a base plate and engaging the print head support. At least the spring base plate is mounted so that it can rotate on a bearing shaft which is preferably parallel to the pressure roller. In addition, there can also be a locking element which can be non-rotationally connected to the bearing shaft, which locking element can be moved into a locking position in a latching locator of the spring base plate to maintain the spring base plate from turning on the bearing shaft.

2. Background Information

A similar printer of the type described above and invented by the present applicant is disclosed in German Patent No. 41 39 891A1. The thermal print head disclosed therein is fastened on a support, which support is mounted rotationally on a bearing shaft which runs parallel to the counterpressure roller. The application force of the print head against the counterpressure roller is defined by a compression spring, wherein the opposite end of which the spring is in contact with a spring base plate. The spring base plate is also rotationally mounted on the bearing shaft. The spring base plate is stopped by a hinged block, or key, which is non-rotationally connected to the bearing shaft and is oriented parallel to the bearing shaft. The spring base plate is pivoted on the bearing shaft when it is necessary to replace the print head with a new or different print head, or when it is necessary to replace the medium which is being printed because it has run out, or when it is necessary to replace the medium being printed with another type of medium.

One disadvantage of such a configuration is that the key is on one hand relatively complex, time-consuming and expensive to manufacture, and on the other hand, on account of its orientation is undesirably deformed as soon as significant azimuthal shear forces are exerted on the plate.

OBJECT OF THE INVENTION

The object of the present invention is therefore to significantly improve a printer so that the print head can be provided with a stable fastening system which can be manufactured economically.

SUMMARY OF THE INVENTION

The present invention teaches that this object can be achieved if the free end of the bearing shaft has a portion which can non-rotationally engage a locking element, wherein the locking element can have at least two positions on the bearing shaft, or a plurality of locking elements are provided which can be interchangeable on the locking shaft, to alter the spring tension between the spring base plate and the print head support. In this regard, An at least one configuration of the present invention, the bearing shaft can preferably have a flattened area over a portion of its length to form two parallel key surfaces, and the locking element can preferably be provided with an opening which resembles a keyhole. This opening can preferably have a circular portion which can preferably have a diameter which approximately equals the diameter of the free end of the bearing shaft, and can also have at least one narrow portion in which the width of the narrow portion approximately equals the distance between the flattened key surfaces.

As such, the locking element can have a first, or locked position in which the narrow portion of the opening is in contact with the parallel key surfaces on the free end of the bearing shaft to non-rotationally engage the locking element with the bearing shaft. The locking element can also have a second, or released position in which the center of the circular portion of the opening coincides with the center of the bearing shaft so that the locking element is free to rotate on the bearing shaft.

If the locking element provided with such a keyhole-like opening is moved from its lock-pushing position (in which, to transmit torque, the narrow portion of the opening is in contact with the parallel key surfaces on the free end of the bearing shaft) into its lock-release position (in which the center of the circular portion of the opening coincides with the center of the bearing shaft) and is then removed, the print head can essentially be easily removed from the bearing shaft. Conversely, this print head or another print head can be put back onto the bearing shaft and then fixed in its operating position by means of the locking element. In such an operating position, the print head can be pressed against the pressure roller with the necessary pressure, and with the interposition of the medium to be printed.

The locking element can essentially only be locked in a pre-determined or pre-set position in a latching locator on the spring base plate of the print head, whereby, when the support is in contact with the pressure roller, the print head is under the tension exerted by the compression spring. If the locking element is moved into an unlocked position, the load spring can be relaxed, which then makes it possible to move the print head support away from the pressure roller, so that the medium to be printed can be replaced with a new one, or a new supply of the same medium being printed can be inserted. Then the print head support can be moved back into engagement with the medium to be printed. After the pivoting of the spring base plate, with a simultaneous tensing of the load spring, when the specified spring tension is reached, as a result of a defined angular position of the spring base plate, the locking element can preferably be moved into its latched position, so that the spring base plate can only retain the angular position it has now reached on the bearing shaft. The bearing shaft can preferably be installed in a stationary fashion on a frame or similar part of the printer, and can be exchanged or replaced if necessary.

The advantages of the invention consist primarily in the economy and ease of manufacture of the locking element, and in its low deformability, which is a consequence of its orientation orthogonal to the axis of the bearing shaft.

To also be able to fix the print head in the axial direction in relation to the bearing shaft, the invention teaches that the thickness of the locking element in the axial direction, at least in the vicinity of the opening, be approximately equal to the partial length of the bearing shaft with the key surfaces. Thus the locking element can essentially be held on the bearing shaft with at least minimal axial movement.

One refinement of the invention provides that the free end of the bearing shaft can preferably have fastened thereto an azimuthally adjustable adjusting piece, on which the parallel key surfaces are preferably located. This adjusting element can preferably be variably positioned on the bearing shaft to provide different orientations of the key surfaces. Once the desired orientation is chosen, this adjusting piece can then preferably be fixed in position. Further, this adjusting piece can preferably be an adjusting shaft which can preferably be centrally connected to the free end of the bearing shaft and can preferably be loosened and fastened in place.

With such an adjusting piece, when it is desired to modify the application force being applied by the spring, the adjusting shaft can preferably be loosened and placed in a new angular position on the bearing shaft. Then the adjusting shaft can once again be fixed in position, thereby defining the position of the locking element which, for its part, essentially determines the angular position of the spring base plate, and thus the adjustment of the support with respect to the pressure roller. But one altogether particular advantage of this configuration is that initially, a basic adjustment of the spring base plate with respect to the print head support can preferably be made with or without the spring, since the basic adjustment is completely independent of all the relevant tolerances. By means of an appropriate gauge, or reference markings, the vertical distance between the spring base plate and the print head support can be defined, and then the adjusting shaft can be fixed in place on the bearing shaft. Then, when the spring is inserted and the locking element is engaged in the spring base plate, the same application pressure of the print head support on the pressure roller or on the medium to be printed can essentially be guaranteed, regardless of the manufacturing tolerances of each individual printer.

In an additional configuration of the invention, the locking element can preferably have at least one locking projection which projects at substantially right angles to the plane of the locking element. This projection of the locking element can preferably engage, in the locked position of the locking element, a groove-shaped latching locator on the spring base plate. The unlocking of the locking element occurs when the locking element on the adjusting shaft is moved so that the locking projection exits the locator groove of the spring base plate. Then the compression spring can be relaxed as indicated above.

One preferred variant of the invention provides that the adjusting shaft can comprise a centering pin that can preferably be engaged in an axial blind hole on the free end of the bearing shaft, and that the adjusting shaft can preferably be penetrated axially by a fastening screw which can be screwed into a threaded hole in the base of the blind hole. Such an adjusting shaft can be easy to manufacture, easy to install and likewise easy to adjust.

This configuration is also characterized by its light weight and small size. The fastening screw, by means of which the adjusting shaft can be held on the bearing shaft, can also be used to fix the adjusting shaft in place on the bearing shaft, i.e. the adjusting shaft can preferably be held on the bearing shaft by an axial clamping action. A slight loosening of the fastening screw can then neutralize the clamping action, so that the adjusting shaft can be rotated by the specified amount on the bearing shaft. When this adjustment is completed, the fastening screw can be tightened once again, to reinstate the clamping action.

An additional configuration of the present invention provides that either the free end of the bearing shaft, or the free end of the adjusting shaft, that is, the end farther from the bearing shaft, can preferably have an external groove which can be used for receiving a hook-shaped free end of a fastener which can be mounted so that it can pivot on the frame, housing etc. The bearing shaft will typically be fastened to the frame or housing at its end farther from the adjusting shaft. However, if, in the vicinity of the adjusting shaft, a second support is provided in the form of a fastener which can be engaged with the adjusting shaft or the bearing shaft, the resultant configuration essentially physically corresponds to a beam which is supported on both ends. Consequently, with the specified force, there can then be an essentially optimal application of the print head support against the pressure roller. For adjustment purposes, the fastener can preferably be mounted by means of a cam so that it can be pivoted and adjusted.

The required application pressure of the print head support against the pressure roller can essentially be determined as a function of the medium to be printed, among other things. A thicker and stiffer medium can typically require a greater application pressure than the pressure which is required for printing on a thinner and more flexible medium. To make the transition from one printing medium to another in the easiest and fastest manner possible, the present invention also teaches that the locking element can preferably have at least two locking projections which are oriented with respect to one another at an angle, whereby the vertex of this angle can preferably correspond to the geometric axis of the circular portion of the opening, and each locking projection can correspond to a narrow portion of the opening. The round portion of the opening can preferably be correspondingly common to both, or all of the locking projections.

As such, if the application pressure is to be increased or decreased, the locking element can first be unlatched from the locator groove on the spring base plate, and can be rotated by the specified angle so that the locator groove then corresponds to the other or another locking projection. As soon as the locking projection and the locator groove are correctly oriented, the locking element can then be moved into the locked position. That can be done either by hand or by the weight of the locking element itself, if the printer is arranged so that the locking surfaces of the bearing shaft are oriented substantially vertically with the locator groove on top, so that the locking element can fall into place with the locking projection in the locator groove.

Naturally, it is also possible to remove the locking element and replace it with another one to achieve the same purpose, namely to increase or decrease the application pressure, but simply shifting one element is typically the simpler and faster method. For example, if there are two locking projections on the locking element, the two projections could preferably be offset from one another by approximately 85 degrees, for example. After the unlocking, the locking element could simply be rotated in the necessary direction of rotation by about one-quarter turn, and then the locking projection could be latched with the locator on the spring base plate to lock the locking element in its new position. But because, in this case, the angle of rotation is not a full 90 degrees, but somewhat less, i.e. 85 degrees as mentioned above, a greater pivoting of the spring base plate toward the print head support results. But since the print head support would typically already be in contact with the pressure roller, the load spring is necessarily compressed to a greater extent, and that results in a more forceful application of the print head support against the pressure roller. If the rotation is in the opposite direction, the application pressure can be decreased correspondingly.

Another variant of the invention provides that the two locking projections could also point in opposite directions, or be oriented at approximately 180 degrees with respect to one another. As such, one projection can preferably be oriented symmetrically with respect to a plane of symmetry of the locking element through the two narrow portions of the opening, and the other projection can be laterally offset somewhat ill relation to the plane of symmetry. With such a configuration, after the unlatching, a rotational movement of about one-half turn would then be necessary. But because the locking projections are not a full 180 degrees from one another, similar to the preceding example wherein the projections were not a full 90 degrees apart, there can be an increase or decrease of the application force. The lateral offset of the two such locking projections disposed at about 180 degrees apart, can preferably amount to approximately one-half the width of a projection.

When the locking projections area is about 180 degrees apart, and when the latching occurs from above, the unlatching can be accomplished by pressing against the lower locking projection, to push the locking element upwardly. However, in the quarter-turn embodiment described above, there would generally not be a substantially large lower portion of the locking element. Thus, corrugated, or non-slip projections, or button shaped areas could then preferably be provided opposite to the projections, or offset from the projections by about 180 degrees, so as to provide an area which could be easily engaged by hand to slide the locking element upwardly.

In a further embodiment of the present invention, the groove-like latch locator for receiving the one or more locking projections therein to perform the locking function, can preferably be advantageously located on a strip-shaped, longitudinal extension of the sleeve-shaped extension of the spring base plate. With such a configuration, it is easy to see that after the locking element has been moved into the release position, the spring base plate can be rotated to a position in which the locking projection of the locking element is essentially disposed behind the longitudinal extension, and thus the spring base plate can be prevented from rotating back towards the pressure roller. In this manner, it can be possible to fix the spring base plate in a position, and thus also to fix the entire print head in a position, which is away from the pressure roller and therefore suitable for changing the ribbon or cleaning the print head or the printer. Of course, it can also be possible to have a second locator groove, offset in the circumferential direction from the first locator groove for the locking projection, in which the locking projection can be engaged only while the ribbon is being changed, or during cleaning or similar operations.

Additional advantageous configurations of the present invention as well as the resulting advantages and functions are disclosed further herebelow. It should also be understood that when the word "invention" is used in this specification, the word "invention" includes inventions, that is, the plural of invention. By stating "invention", the applicants do not in any way admit that the present application does not include more than one patentably and non-obviously distinct invention, and this application may include more than one patentably and non-obviously distinct invention. The applicants hereby assert that the disclosure of this application may include more than one invention, and, in the event that there is more than one invention, that these inventions may be patentable and non-obvious one with respect to the other.

In summary, one aspect of the invention resides broadly in a label printer for printing labels on a label material, the label printer comprising: apparatus for storing label material to be printed upon; at least one printing element, the at least one printing element comprising apparatus for printing on the label material; surface apparatus disposed adjacent the at least one printing element; biasing apparatus for applying a force to the at least one printing element for biasing the at least one printing element into engagement with the surface apparatus; apparatus for feeding label material from the apparatus for storing label material to an area between the at least one printing element and the surface apparatus; apparatus for actuating the at least one printing element to print on the label material between the at least one printing element and the surface apparatus; apparatus for positioning the biasing apparatus relative to the at least one printing element; apparatus for adjusting the apparatus for positioning, the apparatus for adjusting comprising at least first and second positions for moving the biasing apparatus between at least first and second positions; the biasing apparatus in the first position applying a first biasing force to the at least one printing element, and the biasing apparatus in the second position applying a second biasing force to the at least one printing element; the second biasing force being greater than the first biasing force; and apparatus for locking the apparatus for adjusting in at least the first and second positions.

Another aspect of the invention resides broadly in a printer for printing on a material, the printer comprising: at least one printing element for printing on the material; biasing apparatus for applying a force to the at least one printing element for biasing the at least one printing element into engagement with the material for printing on the material; and apparatus for actuating the at least one printing element to print on the material; with a kit for varying the biasing force of the biasing apparatus, the kit comprising: at least a first interchangeable element for positioning the biasing apparatus in a first position within the printer, the biasing apparatus in the first position applying a first biasing force on the at least one printing element; at least a second interchangeable element for positioning the biasing apparatus in a second position within the printer, the biasing apparatus in the second position applying a second biasing force on the at least one printing element; the second biasing force being greater than the first biasing force; and the first interchangeable element and the second interchangeable element being positionally interchangeable within the printer for moving the biasing apparatus between the first and second positions.

A still further aspect of the invention resides broadly in a printer for printing on a material, the printer comprising: apparatus for storing material to be printed upon; at least one printing element, the at least one printing element comprising apparatus for printing on the material; surface apparatus disposed adjacent the at least one printing element; biasing apparatus for applying a force to the at least one printing element for biasing the at least one printing element into engagement with the surface apparatus; apparatus for feeding material to be printed upon from the apparatus for storing material to an area between the at least one printing element and the surface apparatus; apparatus for actuating the at least one printing element to print on the material between the at least one printing element and the surface apparatus; apparatus for positioning the biasing apparatus relative to the at least one printing element; apparatus for adjusting the apparatus for positioning, the apparatus for adjusting comprising at least first and second positions for moving the biasing apparatus between at least first and second positions; the biasing apparatus in the first position applying a first biasing force to the at least one printing element, and the biasing apparatus in the second position applying a second biasing force to the at least one printing element; the second biasing force being greater than the first biasing force; and apparatus for locking the apparatus for adjusting in at least the first and second positions.

BRIEF DESCRIPTION OF THE DRAWINGS

The present invention is explained in greater detail below with reference to the embodiments illustrated in the accompanying drawings, in which.

DESCRIPTION OF THE PREFERRED EMBODIMENTS

Figure 1:
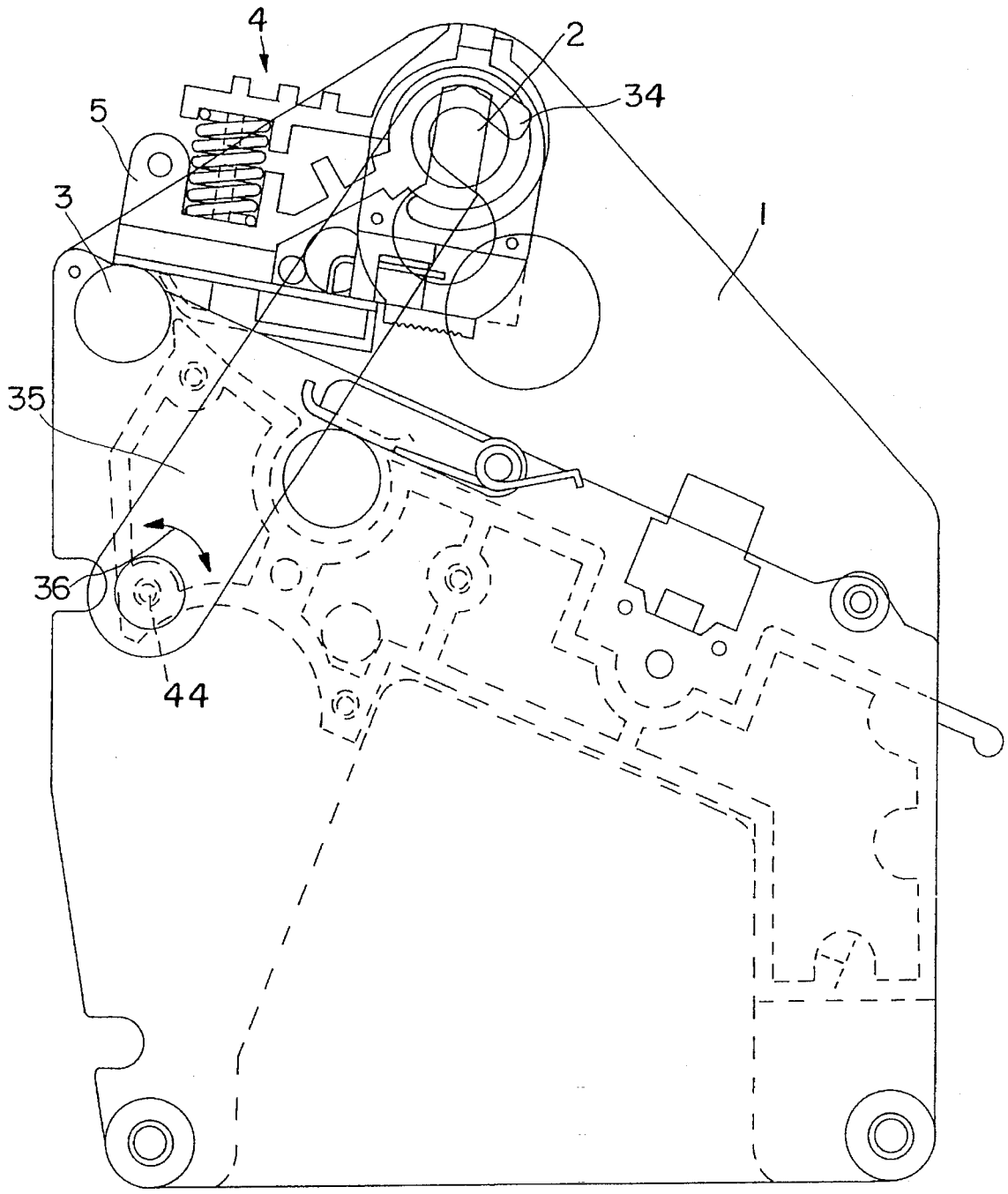
FIG. 1 is a side view of a portion of a printer.
Figure 2:
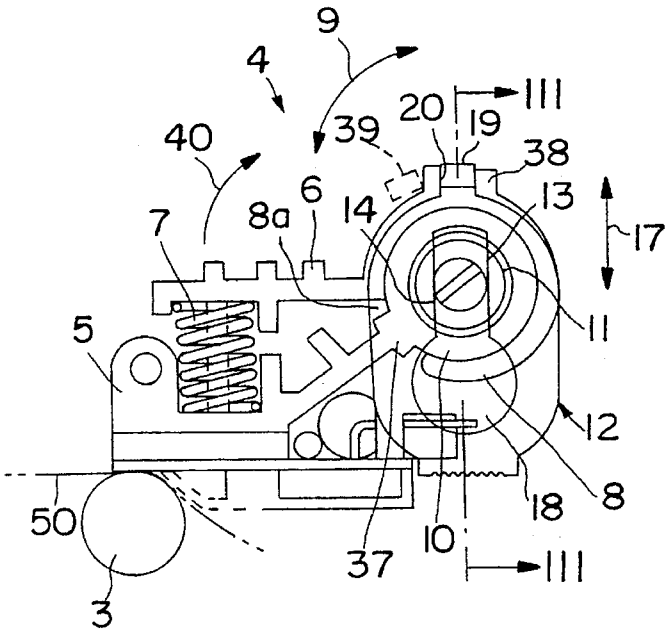
FIG. 2 shows a print head of the printer illustrated in FIG. 1 in a side view.
Figure 3:
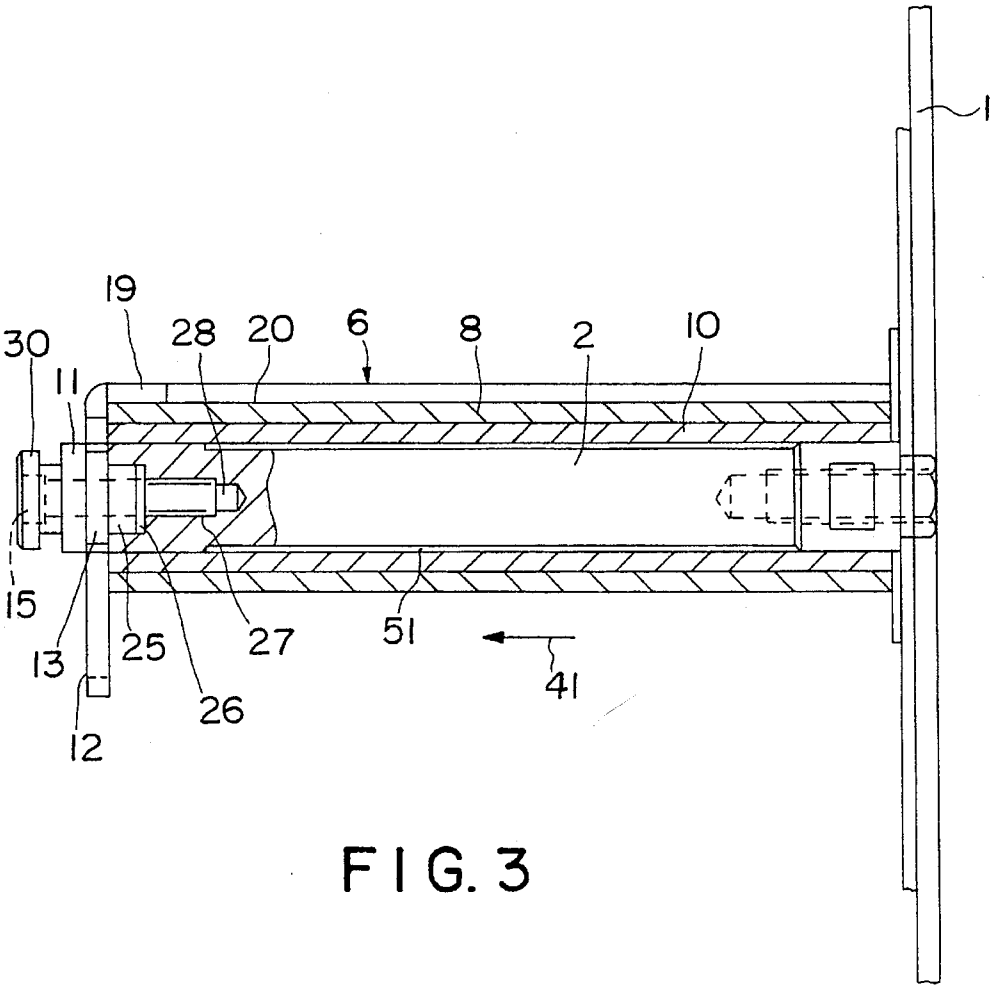
FIG. 3 shows a longitudinal section along Line III—III in FIG. 2.

A bearing shaft 2, as shown in FIG. 1, but which can be seen in greater detail in FIG. 3, can preferably be fastened to a frame 1 or similar part of a printer, e.g. a thermal printer, an ink jet printer, etc. Such a printer will be discussed in more detail herebelow with reference to FIG. 13. Oriented essentially parallel to the geometric axis of the bearing shaft 2 there can preferably be a pressure roller 3. A print head 4 can be provided adjacent the pressure roller 3. As shown, for example in FIG. 2, a medium 50 to be printed can essentially be guided between this pressure roller 3 and the print head 4, and the medium 50 can be pressed against the pressure roller 3 by a support 5 of the print head 4. The medium 50, in question, would typically be a strip of material that is being unwound, e.g. from a roll of paper, or a backing strip with labels.

Figure 4:
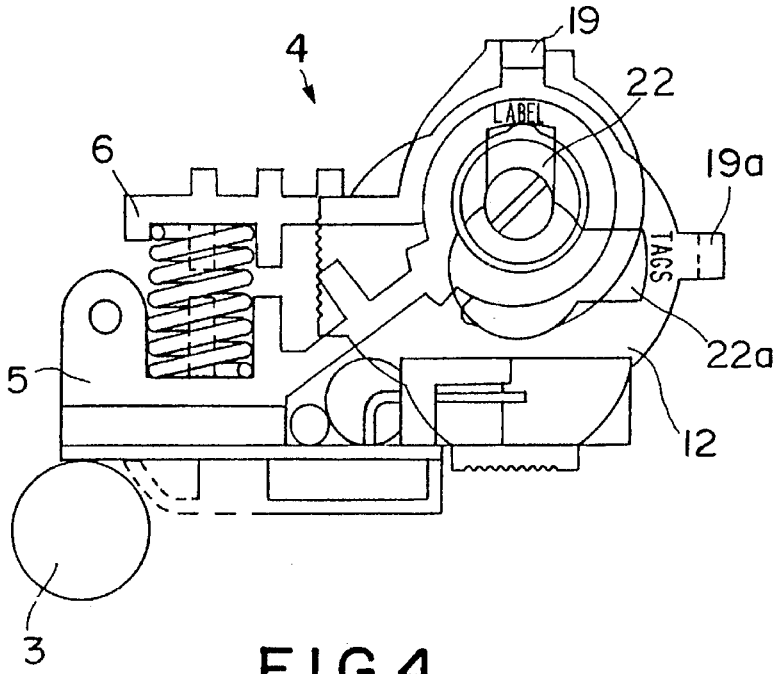
FIG. 4 shows a second embodiment of the print head in a first operating position.
Figure 5:
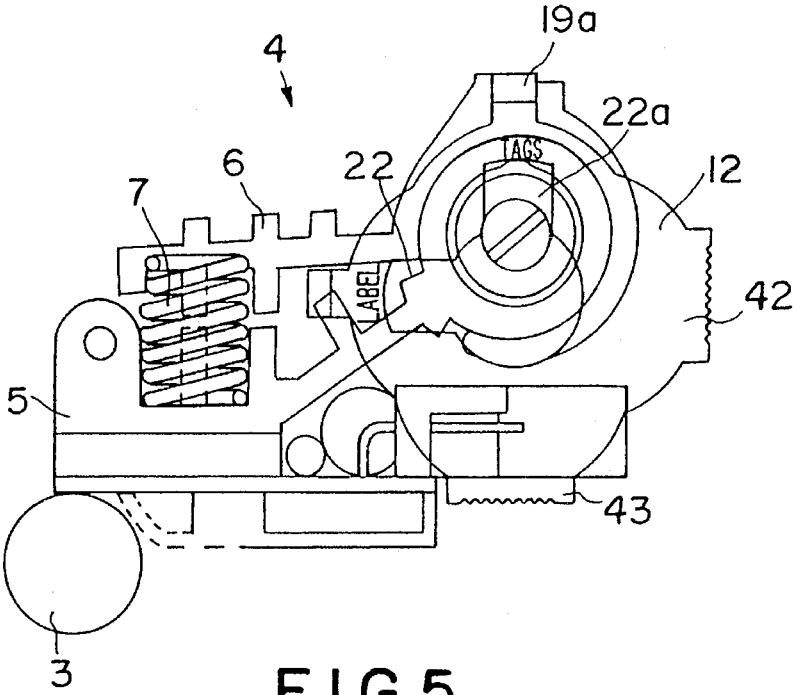
FIG. 5 shows the print head illustrated in FIG. 4 in a second operating position.

As further shown in FIG. 2, the print head support 5 and a spring base plate 6, together with a spring 7, essentially form the most important components of the print head 4. Because in the operating position, as will be explained in greater detail below, the spring base plate 6 assumes a fixed position with respect to the frame 1, the spring 7, which can essentially represent any type of biasing member but can preferably be designed as a coil compression spring, can press the support 5 against the pressure roller 3. As a comparison, FIGS. 4 and 5 show two different positionings of the spring base plate 6. In general, the spring force will thereby be greater, the closer the left-hand free end of the spring base plate 6 is to the support 5. As such the spring force in the configuration depicted in FIG. 5 would typically be greater than the spring force in the configuration depicted in FIG. 4. In general, it has been determined that a stronger application force is desirable when printing thicker or stiffer media.

Figure 4A:
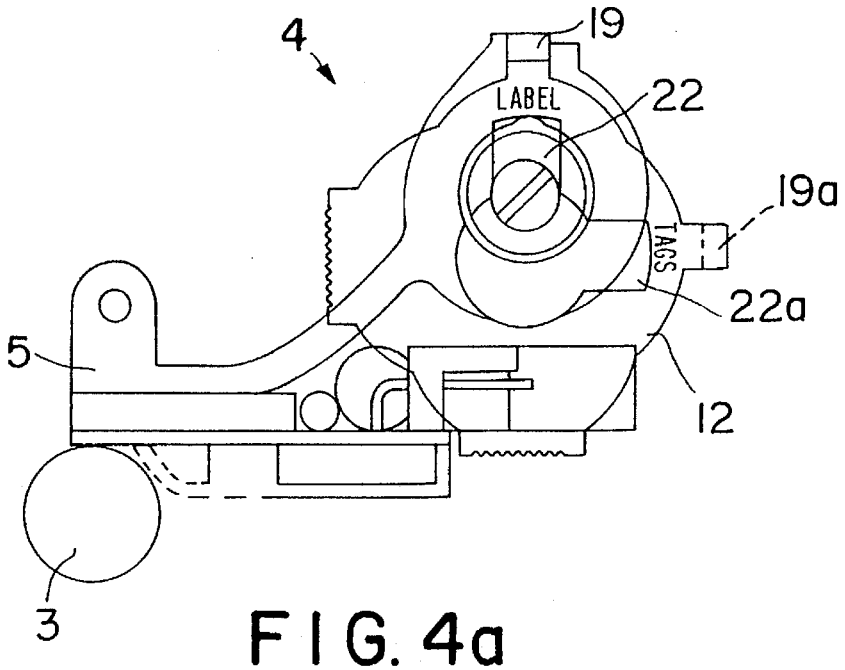
FIG. 4*a* shows a further embodiment of a print head support.
Figure 5A:
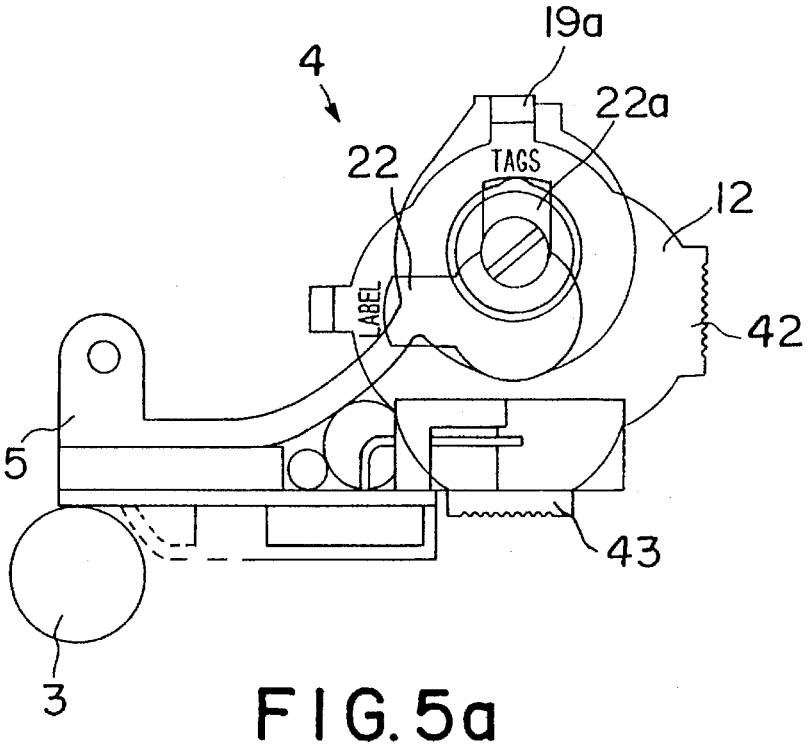
FIG. 5*a* shows the embodiment illustrated in FIG. 4*a* in a second operating position.

In one further possible embodiment of the present invention, it might be possible that there be only a print head support 5, which itself is formed by a leaf spring mounted rotationally on the bearing shaft 2. Thus, the print head support 5 and the biasing member could possibly be embodied by a single component. Such a configuration is shown schematically in FIGS. 4*a* and 5*a*. With such a leaf spring configuration, there could also be two different position of the leaf spring about the bearing shaft two as depicted in FIGS. 4*a* and 5*a*. In FIG. 4*a*, the print head support 5 is engaged An a first position wherein there is a first degree of bending of the print head support, and in FIG. 5*a* the print head support is rotated to a position further counterclockwise than the position indicated in FIG. 4*a*, so that there can be a second degree of bending (exaggerated for purposes of illustration) of the print head support and therefore a stronger biasing force for biasing the printing elements towards the pressure roller 3. In essence, the discussion further herebelow could therefore also apply to the embodiment as illustrated in FIGS. 4*a* and 5*a*.

As shown in FIGS. 2 and 3, the spring base plate 6 can preferably have a sleeve-like extension 8 disposed about the bearing shaft 2. The length of this extension 8 can essentially approximately equal the length of the bearing shaft 2, and thus, by appropriate measures can easily be axially fixed on the bearing shaft 2. The sleeve-like extension 8 can be mounted on the bearing shaft 2 so that the extension 8, and accordingly the base plate 6, can pivot in the direction indicated by the double arrow 9.

In the illustrated embodiment, the extension 8 of the spring base plate 6 is preferably not mounted directly on the bearing shaft 2. Instead, a bearing bushing 10 of the support 5 is preferably interposed between the sleeve-like extension 8 of the spring base plate 6 and the bearing shaft 2. The length of the bushing 10 can also essentially equal the length of the bearing shaft 2. Therefore, while the bearing bushing 10 can preferably fully surround the bearing shaft 2 by 360 degrees, the sleeve-like extension 8 can be designed as a sort of longitudinally-split sleeve having a slit 8*a*, as is illustrated by way of example in FIG. 2. In alternative configurations of the present invention, it would be possible that the bushing 10 did not fully surround the bearing shaft 2, but instead could possibly extend from about 270 degrees up to about 360 degrees therearound, and could include any value therebetween.

On the left-hand or free end of the bearing shaft 2 in FIG. 3, an adjusting piece can preferably be disposed. This adjusting piece can be, as shown in the illustrated embodiments, designed as an adjusting shaft 11. A bar-like locking element 35 as shown in FIG. 1, and described more fully herebelow, can preferably interact with this adjusting shaft 11. As shown in FIGS. 2, 3, 6 and 7, on the adjusting shaft 11 there can preferably be two parallel key surfaces 13, 14, of which only the upward-pointing surface 13 is visible in FIGS. 3, 6 and 7. If the adjusting shaft 11 is pressed firmly against the end-surface of the bearing shaft 2 by means of a fastening screw 15 (FIG. 3) or 16 (FIG. 7), the two key surfaces 13 and 14 can assume a very definite position. Preferably, the position of the surfaces 13 and 14 cannot then be further modified without loosening the fastening screw 15, 16. For example, the two key surfaces 13 and 14 illustrated in FIG. 2 are shown oriented parallel to the vertical. Accordingly, in FIG. 2, a disc-like locking element 12, discussed further herebelow, can essentially only be moved in the direction indicated by the double arrow 17, i.e. only up and down in the vertical direction.

With such a configuration, it should be readily apparent that the adjusting shaft 11 can be rotated slightly in the clockwise direction, or in the counterclockwise direction, to arrive at a diagonal position of the key surfaces 13, 14 with respect to the vertical. With a diagonal orientation, it would also be readily apparent that the direction 17 of the displacement would also no longer be vertical, but would also point diagonally upward to the left or right.

As shown in FIGS. 2 and 3, the disc-like locking element 12 can essentially be formed by a substantially flat plate with an opening 18 and a locking projection 19. This locking projection 19 can preferably be disposed to project essentially perpendicularly to the plane of the locking element 12. In FIG. 2, the plane of the locking element 12 is essentially the plane of the drawing, while the projection 19 would be extending into the page.

In a printer having surfaces 13 and 14 oriented substantially vertically, as shown in FIG. 2, the locking projection 19 can preferably be engaged, from the top, into the locking position in a groove-shaped latching locator 20 on the spring base plate 6. With such a vertical orientation, or an orientation which is somewhat vertical, i.e. approximately 5–10 degrees to each side, if the spring base plate 6 is placed in a suitable angular position, the raised locking element 12 can preferably slide down along the key surfaces 13 and 14, e.g. under its own weight, whereupon the locking projection 19 can enter the groove-shaped latching locator 20. Then, since the disc-like locking element 12 would be prevented from rotating by means of surfaces 13 and 14 of the adjusting shaft 11, the spring base plate 6 will also essentially be unable to move from the angular position on the bearing shaft 2 suitable for the looking position. Consequently, the compression spring 7 can be tensed and the support 5 can be pressed against the pressure roller 3 as a function of the spring tension.

Figure 8:
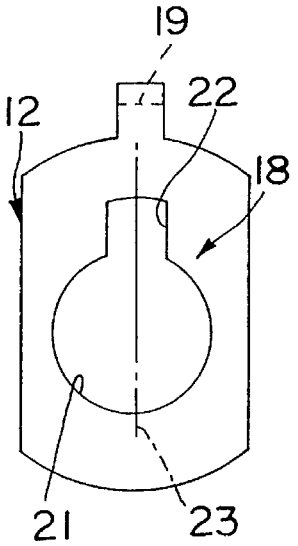
FIGS. 8 to 10 illustrate three different variants of the locking element of the print head.
Figure 9:
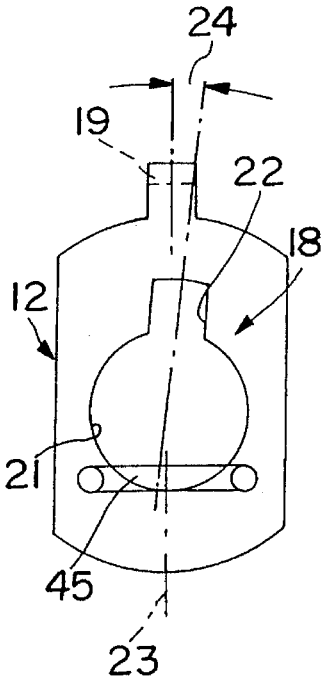

In the embodiments illustrated in FIGS. 8 and 9, the disc-like locking element 12 preferably has a keyhole-shaped opening 18. This opening 18 can preferably have a circular portion 21 and a narrow portion 22, which narrow portion is preferably configured to make a transition into the circular portion 21. In the illustrated embodiment of FIG. 8, the narrow portion 22 of the opening 18 is shown oriented preferably symmetrically with respect to the longitudinal center axis 23, and the same can essentially also be true for the locking projection 19. The diameter of the circular portion 21 can preferably be essentially equal to, with the necessary clearance, the diameter of the adjusting shaft 11, and in the illustrated embodiments, the diameter of portion 21 is also shown as being essentially equal to the diameter of the bearing shaft 2. FIG. 3 shows one embodiment of the bearing shaft 2, in which the bearing shaft 2 has a smaller diameter over the major portion of its length, or strictly speaking over an inner area 51 so that contact with the bushing 10 preferably only occurs adjacent the ends of the shaft 2. Thus, the contact surfaces can be kept small and the friction forces can also be kept low.

In the embodiment illustrated in FIG. 9, the locking projection 19 can preferably be oriented symmetrically to the longitudinal center axis 23, while the longitudinal axis of the narrow portion 22 of the opening encloses an angle 24 with the longitudinal axis 23. This angle 24 is enlarged in the drawing, for purposes of illustration, and can be on the order of magnitude of about 5 degrees, for example. That essentially means that when the locking projection 19 of the locking element 12 illustrated in FIG. 9 is latched, the spring base plate 6, in the orientation as shown in FIG. 2, would need to be pivoted to a greater extent toward the support 5. This greater pivoting distance can thereby result in a greater spring force. This greater spring force would essentially result because the same relative position of the adjusting shaft 11 with respect to the bearing shaft 2 would be used for both of the locking elements 12 of FIGS. 8 and 9. As such, the locking projection 19 of the embodiment of FIG. 9 would be offset to the left from the position in which the projection 19 of the embodiment of FIG. 8 would be located.

Figure 10:
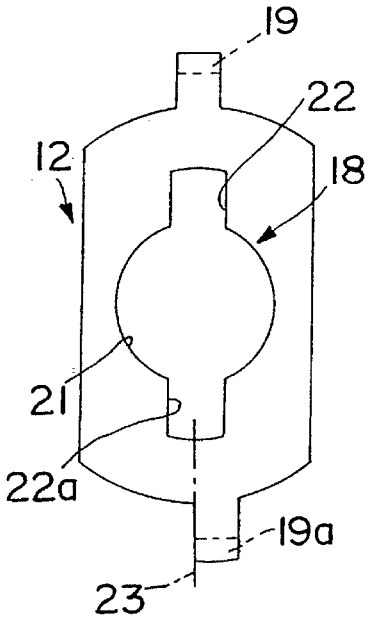

The bar-like locking element 12 illustrated in FIG. 10 is, in a certain sense, a two-sided locking element, because in addition to the locking projection 19, it can also preferably have an opposite locking projection 19a. Consequently, in addition to the narrow portion 22 of the opening, there can also preferably be an additional narrow portion **22*a* of the opening which also empties into the circular portion 21. While the locking projection 19, the narrow portion 22, which are extensions of one another, and the narrow portion 22*a*, preferably lie on the geometrical longitudinal center axis 23, the locking projection 19*a* is angularly offset from the axis 23, e.g. by about one-half the width of the locking projection 19*a*. This offset, in essence, corresponds to the angle 24 in FIG. 9. Accordingly, starting from the one operating position, or the orientation as shown in FIG. 10, the locking element 12 can be rotated by one-half rotation after the unlocking, or an upside down orientation of FIG. 10. The locking element 12 can then be moved into the locking position, whereupon, because of the leftwardly-displaced orientation of the projection 19*a***, there would preferably be an increase of the spring tension, as described above.

In the embodiment illustrated in FIG. 10, the two locking projections 19 and **19*a*, as well as the two narrow portions 22 and 22*a* of the opening, are opposite one another. Alternatively, as illustrated in the embodiments of FIGS. 4 and 5, the narrow portions 22 and 22*a* of the opening can also essentially be offset from one another by about 90 degrees. That is also approximately true for the two locking projections 19 and 19*a*. But strictly speaking, the centers of the two locking projections 19 and 19*a* would essentially enclose an angle between them of preferably only approximately 85 degrees. In other words, the locking projection 19*a* would be offset by approximately 5 degrees with respect to the longitudinal center axis of the narrow portion 22*a* of the opening toward the locking projection 19. In comparison to FIG. 9, that means that of course the narrow portion 22 of the opening can be oriented symmetrically to the longitudinal center axis 23, in which case the locking projection 19 would be offset from the longitudinal center axis 23 by the angle 24**.

FIGS. 4 and 5 show that, on account of this small angular offset which is present, when the locking projection **19*a* is used, as shown in FIG. 5, the spring base plate 6 can be pivoted farther toward the support 5, and thus the spring 7 can be more strongly tensed. For the sake of completeness, it should also be added that the width of the key surfaces 13 and 14 measured in the axial direction can preferably approximately equal the thickness of the bar-like locking element 12**.

Figure 6:
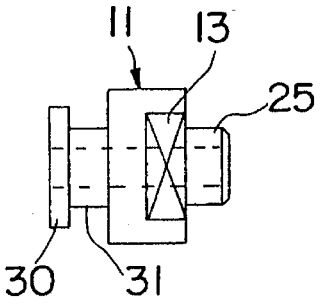
FIG. 6 shows the adjusting shaft illustrated in FIG. 3, in a side view.
Figure 7:
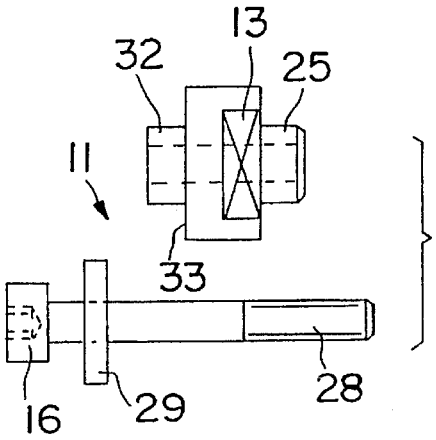
FIG. 7 shows a two-part configuration of an adjusting head.

The adjusting shaft 11 of the embodiments illustrated in FIGS. 6 and 7 can preferably have a centering shaft 25, which as shown in FIG. 3, can be engaged in a blind hole 26 made centrally on the free end of the bearing shaft 2. Also as shown in FIG. 3, at the base of this blind hole 26 there can preferably be a threaded hole 27. The fastening screw 15 of FIG. 3, or 16 of FIG. 7 can be further provided with a threaded portion 28 which can be screwed into the threaded hole 27 in the bearing shaft 2.

The adjusting shaft 11 depicted in FIG. 6 is essentially the same as the adjusting shaft 11 depicted in FIG. 3, as this adjusting shaft preferably already has a collar 30 as a part thereof. For fastening this embodiment of the adjusting shaft 11 into the bearing shaft 2, it might be desirable that a conventional screw, in particular an Allen screw, be used. On the other hand, the embodiment in FIG. 7 is characterized by the use of a screw 16 with a washer 29. The washer 29, in terms of its effect, can essentially correspond to the collar 30 of the adjusting shaft 11 illustrated in FIG. 6.

On the adjusting shaft 11, that is, on the end which extends from the bearing shaft 2 when in use, there can also preferably be an external groove 31 as shown in FIG. 6. On the two-part design illustrated in FIG. 7, this external groove 31 can preferably be formed by the collar 29 of the fastening screw 16 and the pin 32 and the flank 33 at the transition from the larger diameter to the pin 32. This external groove 31 can preferably be used to receive a hook-shaped end 34 of a fastener 35 (see FIG. 1). This fastener 35 can preferably be mounted on the frame 1 of the printer so that the fastener 35 can pivot in the direction indicated by the double arrow 36. In this manner, instead of an unsupported mounting, or a mounting supported at only one end thereof, there can preferably be a beam, formed by the bearing shaft 2 and adjusting shaft 11, which can be supported on both ends. This extra support can essentially ensure that the medium being printed will be correctly, and evenly pressed against the pressure roller 3. To adjust the axial parallelism of the bearing shaft 2 and the pressure roller 3, the pivot of the fastener 35 can preferably be designed as an adjustable cam 44. In general, adjusting cams are well known and therefore this cam 44 will not be described in any further detail herein.

In a further embodiment of the present invention, as depicted in FIG. 2, for example, a longitudinal strip 37 could be provided on the bearing bushing 10 of the support 5. This longitudinal strip 37 can preferably be engaged in the slot **8*a* of the sleeve-like extension 8 of the spring base plate 6 with some circumferential clearance, so that a relative rotation of the two parts can be possible, corresponding to this circumferential clearance. FIG. 2 also shows that the sleeve-like extension 8 of the spring base plate 6 can have a longitudinal extension 38 which extends upwardly. This extension 38 can essentially form the groove-like latching locator 20** therein.

The broken lines 39 in FIG. 2 show a schematic representation of where the projection 19 can also engage the projection 38. It should generally be understood that this location indicated by 39 is not a position to which the projection 19 is turned, but that, after the locking device is released, is a position which is brought about by pivoting the print head 4 upwardly in the direction indicated by the arrow 40, so that the entire projection 38 is rotationally moved to the right, whereby the locking projection 19 would then be able to engage the longitudinal extension 38 from behind, or at the position indicated by 39. The projection 19 would thus be able to hold the print head 4 in the raised position. In other words, for purposes of illustration, FIG. 2 shows this engagement from behind, offset in the direction of rotation.

When the print head 4 is pivoted up into the position wherein the projection 19 can be engaged at the position 39, the medium being printed, 50 in FIG. 2, could more easily be changed as the print head 4 would be disposed away from the pressure roller 3. Alternatively, this raised position of the print head 4 can also be used for the purpose of cleaning the pressure roller 3 or the print head 4.

Removal of the print head 4 from the bearing shaft 2 can also be performed relatively easily with the apparatus as provided by the present invention. In general, for removal of the print head, all that would be necessary would be to push the locking element 12 upwardly in the direction indicated by arrow 17, until the locking element 12 could be pulled off the adjusting shaft via the opening 18. Then, as indicated in FIG. 3, the print head 4 could be pulled off the bearing shaft 2 in the direction indicated by the arrow 41. First, of course, if a fastener 35 (FIG. 1) was being used to support the extending edge of the bearing shaft 2, the fastener 35 would also need to be pivoted into an inactive position, i.e. by a pivoting motion in the counterclockwise direction.

An unintentional displacement of the locking element 12 into the extraction position can be prevented by a bar 45 (FIG. 9) which preferably covers at least a portion of the opening 18. In other words, if an unintentional displacement of the locking element 12 was to occur, the bar 45 which could be disposed across the opening 18 could prevent the opening 18 from being aligned with the adjusting shaft 11, and thereby prevent the locking element 12 from coming off of the adjusting shaft 11. This bar 45 can preferably be detachably fastened to the locking element 12, e.g. by means of two screws. Alternatively, to simplify removal of the locking element 12, the bar 45 could preferably be made of a resilient material which would be deformable under a force. As such a further upward pressure on the locking element 12 would preferably deform the bar 45 and allow the opening 18 to be aligned with the adjusting shaft 11 for removal of the locking element from the adjusting shaft 11. Thus, when it was desirable to change the locking element 12, screws would not need to be extracted to enable the bar 45 to be moved.

FIG. 5 also shows that the locking element 12 can preferably be provided with push buttons 42 and 43, to facilitate pushing up on the locking element to unlock the bar-like locking element 12. The button surfaces can preferably be corrugated or provided with a non-slip surface, such as a rubber material. These buttons 42 and 43 could preferably be oriented opposite to, or at about 180 degrees from the projections 19 and **19*a***, respectively.

A locking element, as described above, could also possibly be provided with further narrow openings 22 and corresponding projections 19 to provide even more than two spring tension settings. Alternatively, a number of individual locking elements 12 could be provided with the printer, with each locking element having a different angle 24 (FIG. 9) of offset. As such, it might be desirable that six such locking elements 19 be provided each having one of the following degrees of offset, 0, 1, 2, 3, 4 and 5. Further, if greater degrees of offset were desired, additional locking elements 12 could be provided therefore, which might have one of the following degrees of offset, 6, 7, 8, 9 or 10. Further, if two positions were provided on each locking element 12, as shown in FIGS. 4 and 5, and different degrees of offset were desired, a number of locking elements 12 could be provided with preferably, for example, the following pairs of offset degrees: 0 and 3; 1 and 4; and 2 and 5. It should generally be understood that variations on the offset degrees provided per locking element 12 would be well within the skill of the artisan.

The print head 4 and locking element 12 as described hereabove can be utilized as a component of a printing arrangement as discussed herebelow with reference to FIGS.

Figure 12:
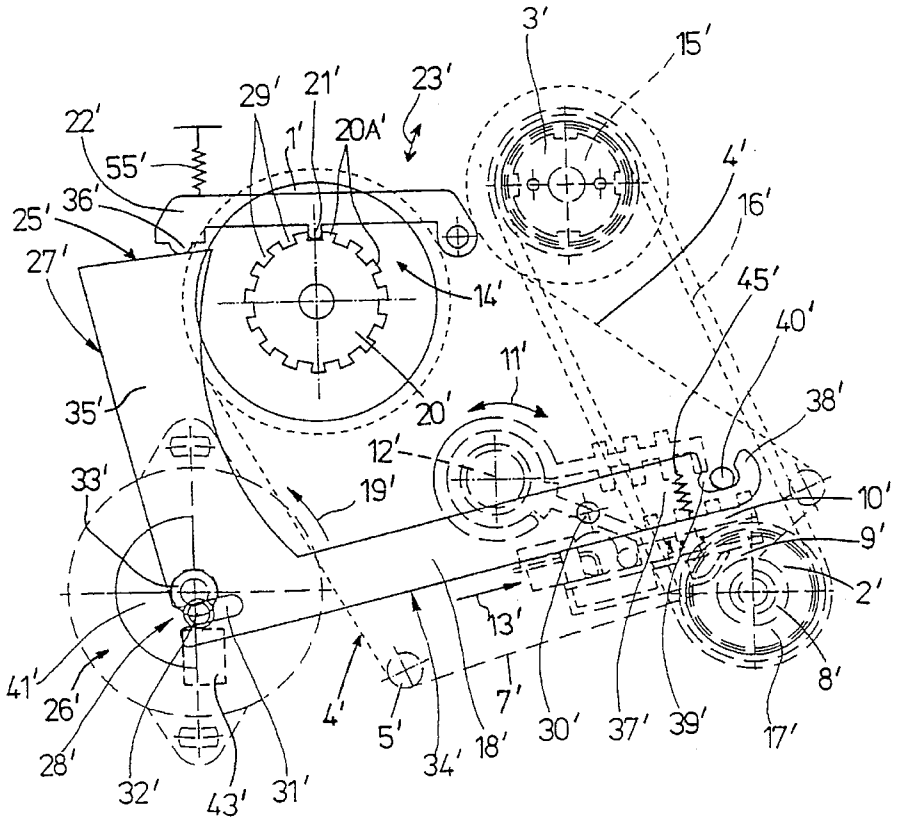
FIGS. 11 and 12 show a more detailed view of a printer in essentially the same perspective as FIG. 1.
Figure 11:
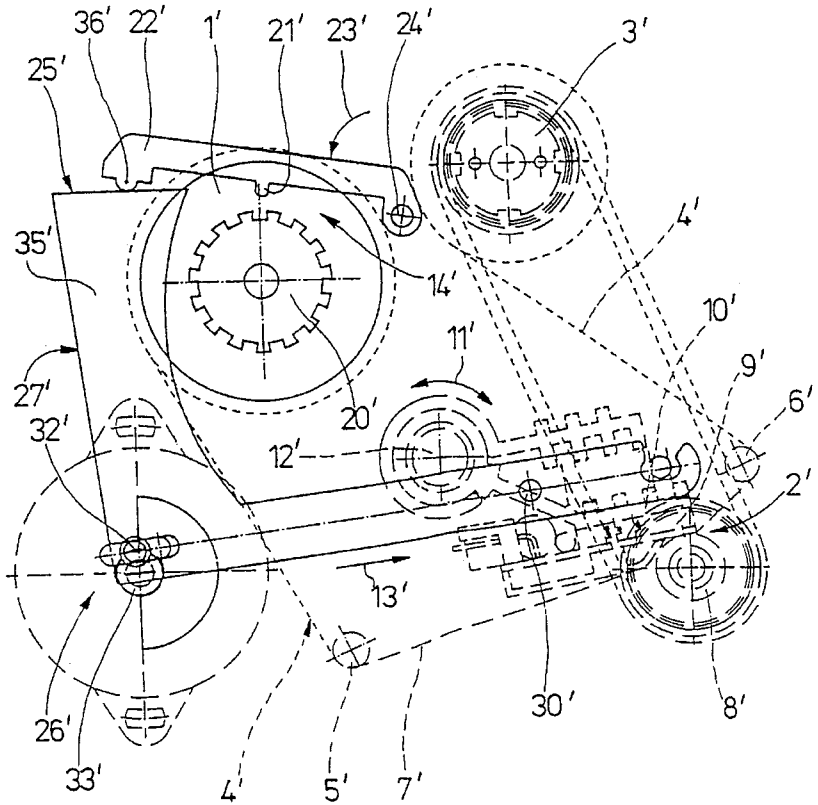

11 and 12. In a printer for printing labels, there can typically be a printing area 2' as shown in FIGS. 11 and 12. For the following, FIGS. 11 and 12 should essentially be considered together and reference numbers which refer to one could also refer to the other. In such a printer, an ink ribbon, or thermal transfer ribbon 4' can be unwound from a first spool 1', can be guided through the printing area 2', and can then be wound up on a second spool 3', which could alternately be termed a "take-up spool". The two spools 1' and 3', are preferably located in an ink ribbon cassette, as discussed above. In addition to the spools 1' and 3' guide rollers 5' and 6' can also preferably be a part of the ink ribbon cassette.

A portion of the thermal transfer ribbon 4' which extends between the guide rollers 5' and 6' can essentially be termed an active strand 7' of the ribbon 4'. In the depicted embodiment, this active strand 7' is preferably guided by means of a counterpressure roller 8' on the printer. Between the thermal transfer ribbon 4' and the counterpressure roller 8', a medium to be printed can preferably be guided. Such a printing medium can, for example, include a backing strip which carries labels to be printed. During printing, a thermal print head 9' would typically be disposed in contact with the moving, working strand 7' of the thermal transfer ribbon 4' and, with the interposition of the above-mentioned medium to be printed, presses the thermal transfer ribbon 4' and printing medium firmly against the counterpressure roller 8'.

The application force for pressing the thermal transfer ribbon 4' and printing medium firmly against the counterpressure roller 8' can be applied by a biasing device as described hereabove. This biasing device, or coil compression spring 45' in FIG. 12, preferably pushes on a pivoting arm 10'. The pivoting arm 10' supports the thermal print head 9'. The above-mentioned arm 10', which is pushed down by the coil compression spring 45', can pivot around the axis 12' in the direction indicated by the double arrow 11'.

The medium to be printed can also be unwound from a roll or spool and can be wound up, if necessary, on another roll or spool. The medium to be printed can typically be divided into individual fields to be printed, or the medium can also contain labels, for example, which do not need to be printed all the way to their front and rear edges. To this extent, therefore, there can typically-be spaces which remain unprinted between succeeding, identical printed segments in the direction of transport 13' of the ribbon and of the medium being printed.

In the unprinted sections of the medium being printed, that is, when no printing is being done, a continual advancement of the thermal transfer ribbon 4' would represent an unjustified expense. In other words, with a continual advancement of the thermal transfer ribbon 4' during periods when no printing is being performed, there would typically be portions of the thermal transfer ribbon 4' which would not have therefore been used, thus resulting in wasted ribbon 4'. The present invention teaches that unnecessary consumption of the thermal transfer ribbon 4' can be reduced, or even possibly eliminated, by stopping advance of the thermal transfer ribbon 4' whenever the medium to be printed, which is in constant motion, does not need to be printed at a given point.

The present invention teaches that this comparatively sudden stopping of the thermal transfer ribbon 4' after printing the "last line" can preferably be accomplished by means of a stopping device 14'. In general, to print in a thermal transfer process, the printer basically requires a corresponding electronic control system with a computer. Because such a control system would essentially already have access to all the necessary data regarding the stopping and starting of printing, the existing control system can preferably also be used to control the stopping device 14'. In other words, the existing control system could preferably be used to move the stopping device 14' into the operating position when the thermal transfer ribbon 4' need not advance, and to release the stopping device 14' once again when the medium to be printed has advanced to the point where the next area to be printed has arrived in the printing area 2'.

The stopping device 14' can preferably also operate in conjunction with a slip clutch 15' as shown in FIG. 12, which is not illustrated or explained in any further detail herein, as slip clutches are generally well known. In the illustrated embodiment of FIG. 12, the driving side of the slip clutch 15' is driven by means of an endless drive element 16', e.g. a toothed belt, and by an electric motor 17'. Because of the presence of the slip clutch, during a printing job, the electric motor 17' can essentially always remain turned on, so that the driving side of the slip clutch 15' is in constant rotation. The slip clutch 15' transmits the torque from its driving side to its driven side, on which the second spool 3' would generally be located. If the stopping device 14', however, or some other cause, such as jamming, were to abruptly interrupt the movement of the ribbon 4', the friction moment of the slip clutch 15' would essentially no longer suffice to transmit the driving force of the electric motor 17' to the driven side of the slip clutch 15', and the slip clutch 15' would consequently slip. Then, as soon as the stopping device 14', once again releases the first spool 1', the driven side of the slip clutch 15' could also move, and consequently the thermal transfer ribbon 4', unwound from the first spool 1', could be wound up again on the second spool 3'.

For various reasons, one of which is to at least prevent a tearing of the thermal transfer ribbon 4' when it is stationary, during these stationary phases, the application pressure with which the thermal print head 9' is pressed against the counterpressure roller 8' should also preferably be overcome. This can be done in a simple manner, e.g. by pivoting an actuation element 18' at the appropriate time, in the direction indicated by the arrow 19', under the control of the printer control system. The actuation element 18' can be connected in a manner not shown in any further detail to the pivoting arm 10', and consequently can drive the arm 10' in the same direction of rotation, whereupon the thermal print head 9' can be raised from the counterpressure roller 8'.

In purely theoretical terms, of course, the counterpressure roller 8' could also be lowered away from the print head 9', but the first alternative is preferable for a variety of reasons. As discussed earlier, since the print head 9' is biased towards the counterpressure roller 8', a movement of the print head 9' against the biasing force would immediately neutralize the biasing force, while a movement of the counterpressure roller 8' away from the print head 9' would only gradually decrease the application force over a distance. On the other hand, if the counterpressure roller 8' was being biased into engagement with the print head 9', a preferred movement of the counterpressure roller might be desirable.

To provide a locking device in accordance with the present invention, the first spool 1' can preferably be non-rotationally connected to an externally-toothed wheel 20'. Above the wheel 20', in the plane of the depicted embodiment, a locking tooth 21' can be provided for engaging with the teeth 20A' of the toothed wheel 20'. The locking tooth 21' can be held by a pivoting arm 22' and can preferably be manufactured as one piece with the pivoting arm 22'. The pivoting arm 22' can preferably be pivoted around an axis 24' in the direction indicated by the double arrow 23', or that is, towards and away from the toothed wheel 20'. During printing, the pivoting arm 22' would typically be in the angular position indicated in FIG. 11, that is, an unengaged position with respect to the toothed wheel 20'. The arm 22' can preferably be retained in this inactive position by means of a holding device, such as a regulatable locking element 25'. By means of a drive mechanism 26', which can preferably be controlled by the control system of the printer, the pivoting arm 22' can be moved into the active position shown ' in FIG. 12.

In the illustrated embodiment, this movement takes place indirectly, i.e. the locking element 25' is located on a lever 27', which lever 27' is preferably mounted so that it can pivot, and which lever 27' can be adjusted by means of a cam drive mechanism 28' (see FIG. 12), which cam drive mechanism 28' can be moved by the drive mechanism 26'. The lever 27' is preferably an angular lever having legs 34' and 35'. The upper end of leg 35', in the drawing, preferably forms the locking element 25'. As soon as this upper end is lowered, the pivoting arm 22' follows this movement, and the locking tooth 21' can thereby be engaged in the next tooth space 29', as shown in FIG. 12. The pivoting arm can preferably follow the downward movement of the lever 27' due to gravity, however, if alternative positioning of the printing arrangement is desired, a biasing device 55' could preferably be provided to bias the arm 22' towards the toothed wheel 20'.

The lever 27' can rotate around an axis 30'. In the vicinity of the angle corner of the lever 27', that is, in the vicinity of the drive 26', there can preferably be an open-edged slot 31' in which a pin 32' can be engaged. Both the slot 31' and the pin 32' are components of a cam drive mechanism 28'. The pin 32' can preferably be attached to a drivable rotational element 33'. This rotational element 33', in accordance with one embodiment of the present invention, can preferably execute only approximately one-half of a revolution to move the pin 32' through an arc of about 180 degrees, and thereby move the lever 27'. Thus, in accordance with the depicted embodiment, to lower the lever 27' from the position shown in FIG. 11 to the position shown in FIG. 12, the rotational element 33' can be rotated 180 degrees in a first direction which could be either a clockwise or counterclockwise direction. Then to move the lever 27' back into its raised position, the rotational element 33' could be moved in a reverse direction 180 degrees. Alternatively, a raising movement could be brought about by a further 180 degree movement in the first direction. Thus, a reversing motor could be used as the drive 26' to provide a clockwise-counterclockwise movement as discussed above. Alternatively, a one-directional motor could be used as the drive 26' to provide only one of: a clockwise movement, or a counterclockwise movement, that is, provided that the slot 31' could accommodate the pin 32' throughout the full circumferential motion of the pin 32'.

The slot 31', as shown in FIG. 12 for example, can preferably extend approximately in the longitudinal direction of the leg 34' of the angular lever 27' hinged to the axis 30'. Consequently, the locking element 25' can preferably be located on the free leg 35'. The pivoting arm 22', with the locking tooth 21', as shown in the illustrated embodiment, can preferably be a simple pivoting lever which has a projection, such as a preferably convex support element 36', on its free end. This support element 36' can preferably be in contact on top with the end surface of the free leg 35' which forms the locking element As shown in FIG. 12, the hinged leg 34' of the pivoting angular lever 27' can preferably extend beyond the axis 30'. The extending arm which is thereby formed is designated by 37'. This arm 37' can preferably be hook-shaped on its free end, and the hook 38' can essentially be formed by a slot 39' which can be open on the side. A bolt 40', which can be fastened to the pivoting arm 10' can be engaged in this slot 39'. The pivoting arm 10' can in turn preferably be engaged to the print head 9'. It could also be conceivable that a direct connection between the print head 9' and the end 37' of the lever 27' could be provided.

When the rotational element 33' with the pin 32', starting from its angular position illustrated in FIG. 11, is rotated by approximately 180 degrees, e.g. in a counterclockwise direction, the pin 32', which is engaged in the slot 31', can pivot the lever 27' also in the counterclockwise direction around its axis of rotation 30'. As a result, on one hand by means of the connection 39', 40', the thermal print head 9' can be raised from the counterpressure roller 8' and the pressure on the medium to be printed and the thermal transfer ribbon 4'. An the printing area 2' can be neutralized. In addition, the locking element 25' can be lowered, whereupon the pivoting arm 22' can execute a pivoting motion in the direction indicated by the arrow 23'. Thus, while the pressure is being released there can be an essentially simultaneous engagement of the locking tooth 21' in a next available tooth space 29', as shown in FIG. 12. The stopping of the thermal printing ribbon 9 is therefore basically accompanied by the elimination of the pressure on the print head 9' in the printing area 2'.

The control for the 180 degree rotational movement of rotational element 33' can preferably be achieved by means of a control cam 41', which can preferably be non-rotationally connected to the rotational element 33', and a sensor 43', e.g. a sensor which could possibly operate on an optical principle, which can preferably sense the two radial edges of the control cam 41'. In this area, therefore, there is a corresponding control unit for the drive motor 26' of the rotational element 33'. In other words, a sensor can preferably be provided for indicating when the cam 41' has attained a 180 degree rotation to thereby stop movement of the cam 41' and the lever 27'.

Figure 13:
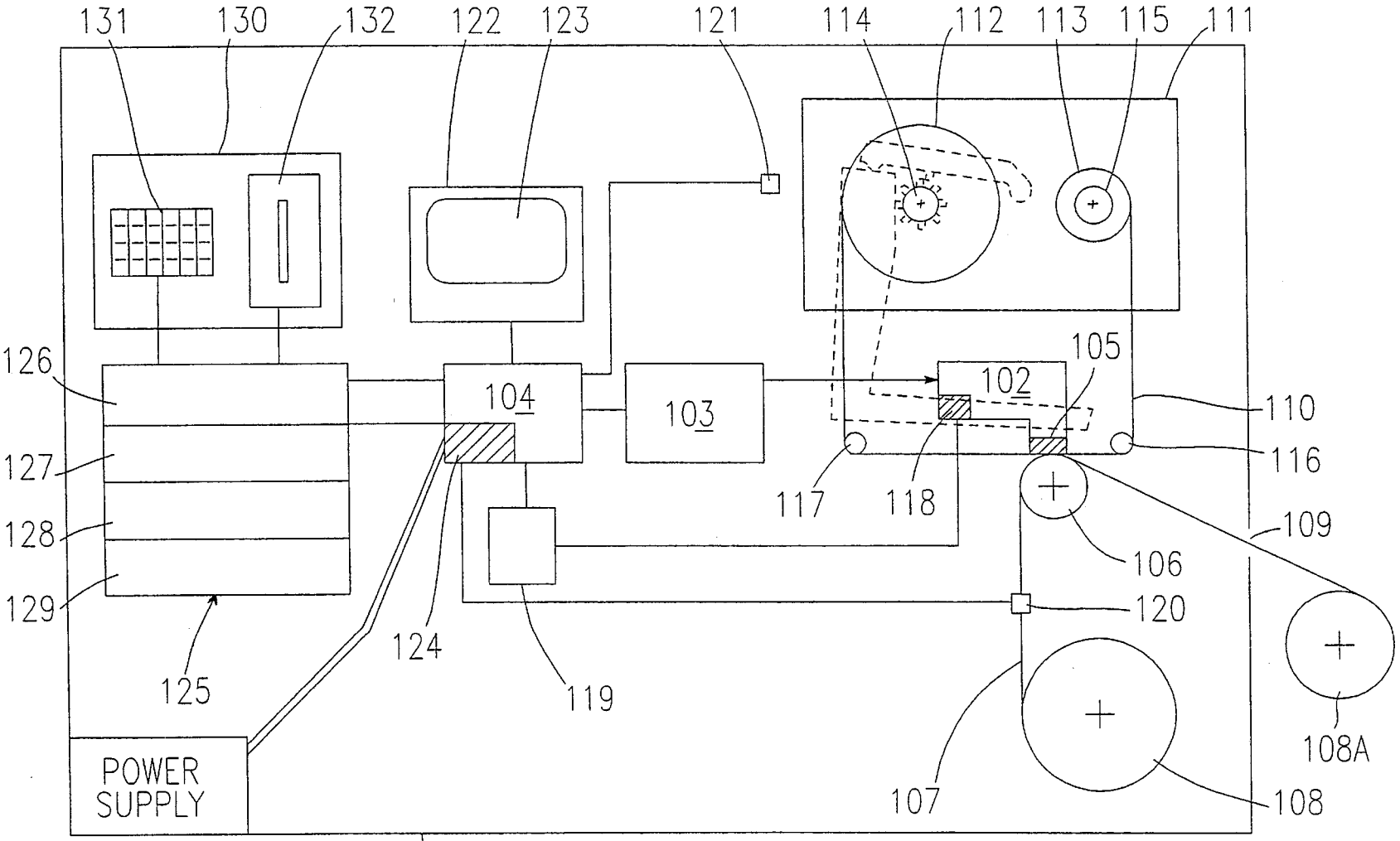
FIG. 13 provides a general depiction of additional components of a printer.

The above-discussed components of a printing arrangement can be portions of a thermal printer as described herebelow with reference to FIG. 13. A thermal printer 101 has a thermal print head 102 which can be electrically connected by means of a control circuit 103 to a computer processor 104. On the underside of the thermal print head 102 there are preferably electrically activated heating elements 105, which can be maintained in contact against a counterpressure roller 106. Preferably, the heating elements 105 can be oriented in a straight line lying perpendicular to the plane of the drawing and aligned with a longitudinal axis of the counterpressure roller 106.

A label strip 107 can be introduced between the heating elements 105 and the counterpressure roller 106. As the label strip 107 is printed, it is preferably Unrolled by means of a label strip payoff reel 108, and can, if desired be taken up by a take-up reel 108A. After having been printed with the desired printing information, the label strip 107 can be output by means of an outlet opening 109 of the thermal printer 101. The above described thermal printer apparatus 101, including the print head 102, the heating elements 105 and the label strips 107, are generally known in the art and are not described in great detail herein.

The label strip 107 can be temperature-sensitive paper which is printed as it is moved past the pan-shaped heating elements 105. Appropriate ones of the heating elements 105 can be heated as necessary, and the areas of the paper, or label strip 107, to which heat is applied can thereby be darkened at the desired points. Alternatively, the label strip 107 can also be conventional writing paper. With such conventional writing paper, it is generally necessary to introduce a thermal transfer ink ribbon 110 between the label strip 107 and the heating elements 105 of the thermal print head 102. The thermal transfer ink ribbon 110 can essentially be coated with temperature sensitive ink, which can preferably be configured to melt at the points where it is moved past activated, or heated, heating elements 105. The melted ink then can adhere to the conventional label strip 107 to thereby form a desired printed image.

Such a thermal transfer ink ribbon 110 can preferably be housed in a cassette 111, which cassette 111 can preferably have a payoff reel 112 and a take-up reel 113 therein. The cassette 111 can generally be positioned within the thermal printer 101 by means of devices 114, 115 which are configured to fit into, or hold the reels 112, 113. The thermal printer 101 can also preferably have deflector rollers 116, and 117 disposed within the printer housing, to direct the path of the ink transfer ribbon past the print head 102 and heating elements 105. Such deflector rollers 116, 117 essentially make certain that the thermal transfer ink ribbon 110 is moved past the heating elements 105 at the optimum angle for transferring the ink to the paper, or label strip 107, in which the ribbon 110 is An contact at the print head 105. Such thermal transfer ink ribbons, and the manner of transferring the ink thereon, are also considered to be well known in the art.

The thermal print head 102 can be equipped with a temperature sensor 118 to transmit an analog electrical signal corresponding to the temperature of the thermal print head 102 to an analog-digital (A-D) converter 119. This A-D converter can then digitize the temperature signal and transmit the digitized signal to the processor 104.

The processor 104 can also preferably be connected to a paper sensor 120, which can be, for example, a photoelectric cell which detects the presence of a label strip 107, and reports the presence or absence of a strip to the processor 104. Alternatively, the paper sensor 120 can also be configured as a laser scanner which is capable of reading bar codes. If such a scanner were to be used, bar code markings, indicative of the type of paper being used, could be provided on the paper strips. The bar code markings on the label strip 107 could then be automatically read by the scanner to provide the processor 104 with information not only about the presence of the label strip material, but also about the type of label strip material present. These data can be retrieved by the processor 104 for further processing.

The processor 104 can also preferably be electrically connected to an ink ribbon sensor 121. This ink ribbon sensor 121 can be designed either as a photoelectric cell, only to detect the presence of the thermal transfer ink ribbon 110, or, as discussed above for the paper sensor, can be designed as a laser scanner which can read the bar codes applied to the cassette 111, to thereby provide information on the material, or type of thermal transfer ink ribbon 110 being used. Photoelectric cells and laser scanners are essentially well known, and are therefore not described in any further detail herein.

Other types of sensors or scanners, within the skill of the artisan could also be used for detecting the paper or ink ribbon, or alternately scanning information provided on the paper or ink ribbon.

In order to make the thermal printer more "user-friendly", the processor 104 can preferably be connected to an optical data output medium 122. Such an output device 122 could provide an LCD screen 123 for displaying variables which the operator may have to adjust, or to alternately display control commands for operation of the printer. Various alternative output devices would also be within the skill of the artisan.

The processor 104 can also preferably be equipped with a working memory 124, the capacity of which is preferably sufficient to buffer the control data supplied both by a read/write memory 125 connected to the processor 104, and also by the paper sensor 120 and by the ink ribbon sensor 121 during a printing process. The processor 104 can preferably use this information to control the label printer 101. With such a buffer, or working memory 124, the processor could essentially operate at higher speeds as data transfer between the read/write memory 125 and the processor 104 would not need to continuously take place.

The read/write memory 125 can essentially be partitioned into several areas depending on the features of the thermal printer. The example shown in FIG. 13 essentially depicts four memory areas 126 to 129, but more or less could be provided, with the possibility for future expansion as needed. The memory areas could be set up as provided below, but the following is meant as an example only, and various other set-ups would be well within the skill of the artisan.

A first memory area 126, could be used to store the information which is to be applied, or printed on the labels.

A second memory area 127 could be used to store a data matrix corresponding to the various types of paper which are usable for the label strips 107. A third memory 128 could be used to store the printing speed, that can be set or selected by the operator, and a fourth memory area 129 could be used to store the ink ribbon data corresponding to the various types of paper of the specified label strip 107.

The number of data matrices stored in the second memory area 127 should preferably correspond to the number of types of paper of the label strips 107 which are specified for use on the particular printer. Each of these data matrices is indicative of the type of paper it describes, and can, for example, be an array of three rows of data, whereby the data in the first row could indicate the thermal print head temperatures, the data in the second row could indicate the printing speeds, and the data in the third row could indicate reference energy values. During printing, these reference energy values can be transmitted by the processor 104 preferably directly to the control circuit 103 to control the thermal energies to be generated by the thermal print head 102 in each of the individual heating elements 105 to thereby produce an optimized print. For each data pair consisting of a thermal print head temperature and a printing speed, there is preferably a corresponding reference energy value for the paper being printed upon. Thus, when a temperature and a speed value are input, a reference energy value can clearly be determined and output.

The ink ribbon data contained in the fourth memory area 129 could essentially be described as a list consisting of three rows. The data in the first row could indicate the type of paper of the label strip 107 to be used. The' data in the second row could have the values 0 and 1, whereby a "0" can mean that when the type of paper listed in the first row is being used for printing, no thermal transfer ink ribbon is necessary, and a "1" could indicate that an ink ribbon is necessary for printing. In the third row, there can either be a "0", which can indicate that when a particular type of paper is used, no special requirements need to be set for the material of the thermal transfer ink ribbon 10, or another digit, i.e., 1, 2, 3, etc. could indicate which type of ink ribbon must be used to print the specific type of paper.

The above described data arrays can preferably be read into the read/write memory 125 by means of a data input device 130. Such an input device 130 could essentially be a computer keyboard 131 and a card reader device 132, or in essence could essentially be any type of input mechanism which are commonly used for entering data values into computers, i.e. a scanner.

During the installation of the thermal printer, the data matrices corresponding to the types of paper to be used can be read into the corresponding memory area, or in this example, the second memory area 127. Likewise, the ink ribbon data can be read into its corresponding memory area, or the fourth memory area 129 of the read/write memory 125. Then, when printing is to be done, the data to be printed on the label strip 107 can be input into its corresponding memory area, or the first memory area 126 by means of the input device 130, or computer keyboard 131 and the card reader 132.

The processor 104, via the LCD screen 123, can then preferably output a list of the types of paper that Were read into the second memory area 127. The operator can then manually select the data matrix corresponding to the type of paper to be used. Further, the printer may also be set up so that the operator is given an opportunity to verify whether there is a data matrix already stored for the particular type of paper of the label strip 107. Thus, if necessary, the appropriate data matrix can then be read into the corresponding memory area, or second memory area 127 of the read/write memory 125. Alternatively, a label strip 107 of a paper with a data matrix already stored in the memory and displayed on the LCD screen 123 can be introduced into the thermal printer 101.

The processor 104 can then retrieve the data matrix corresponding to the type of paper selected, and can call up the corresponding .nk ribbon data from the read/write memory 125, and store these data in its working memory 124.

By means of the LCD screen 123, the processor 104 can output a list of the possible printing speeds contained in the data matrix, and thus enable the operator to select a desired printing speed. If the operator does not select a speeds the processor can automatically default to a predetermined printer speed, which can be, for example, the maximum possible printing speed of the printer. Alternately, if it is known that operation at the maximum speed is not desired, alternative default speeds, such as 50% or 75% of the maximum speed could be entered as the default speed if so desired.

The above described thermal printer 101, thereby provides an opportunity at the beginning of the printing process to select a printing speed, which printing speed can then be stored in the third memory area 128 of the read/write memory 125. After the selected data matrix has been read into the working memory 124, the processor 104 can preferably retrieve the value corresponding to the desired printing speed from the third memory area 128, and compare this value to the speed values contained in the data matrix. The processor 104 can then preferably automatically select the value from the data matrix which either corresponds to, or is closest to the selected printing speed.

By means of the temperature sensor 118, the processor 104 can measure the temperature of the thermal print head 102 and then select, from the data matrix, the temperature value corresponding to, or closest to this value.

From the data matrix, and using the above-chosen temperature and speed values, the processor 104 can then preferably select the reference energy value which is specified for the measured value of the thermal print head temperature and the selected or specified printing speed.

In addition to the above-determinations, the processor can also proceed with determining whether or not an ink ribbon is needed, or what type of ribbon is needed. On the basis of the ink ribbon data read into the working memory 124 and specific to the type of paper, and on the basis of the data supplied by the ink ribbon sensor 121, the processor 104 can then check for the following conditions:

A) whether there is a "1" in the second row of the ink ribbon data (indicating that an ink ribbon is needed), and whether a cassette 111 for the thermal transfer ink ribbon 110 has been inserted; or B) whether there is a "0" in this position and no cassette 111 has been inserted.

If the requirements indicated above are not fulfilled, the processor can be set up to indicate such to the operator by means of an error message, either a visible, or audible warning. The error message could also contain information as to how to correct the problem, for example, either to remove the wrong cassette 111 which has been inserted, or to insert the missing cassette 111.

The processor 104 can also check to see whether there is a "0" in the third row of the ink ribbon data list, or possibly another digit identifying a thermal transfer ink ribbon 110. On the basis of this value and the values supplied by the ink ribbon sensor 121, the processor 104 can check, if necessary, to see whether the correct thermal transfer ink ribbon 110 has been inserted. By means of an error message displayed on the LCD screen 123, or possibly by an audible warning, the operator can preferably be requested to insert the correct thermal transfer ink ribbon 110 into the printer, if necessary.

Also, on the basis of the data supplied by the paper sensor 120, the processor 104 can preferably check to see whether a label strip 107 has been inserted. A warning signal can also be generated if a paper strip is not present, indicating to the operator that paper needs to be inserted.

The processor 104 can then retrieve the printing information read into the first memory area 126 of the read/write memory 125, and initiate the printing process. To initiate the printing process, the processor 104 will essentially transmit the printing information, the selected or specified printing speed, and the reference energy value selected from the data matrix to the control circuit 103 of the thermal print head 102. The control circuit 103, by means of electrical connections and driver circuits (not shown, but commonly known in the art), can then drive the counterpressure roller 106 to transport the label strip 107, as well as the thermal transfer ink ribbon 110, preferably by means of electric motors, not shown in the figure. The motor for driving the ink ribbon 110 would preferably be connected to the take-up reel 113. The control circuit 103 can also preferably start the printing process itself by activating the individual heating elements 105 as a function of the input and measured data.

The reference energy value determined from the printing speed and the thermal print head temperature essentially then controls the thermal energy generated by the heating elements 105. The thermal energy generated would preferably be greater, the higher the printing speed set, and the lower the measured thermal print head temperature. Preferably, the thermal energy can be controlled by changing the times at which a specified voltage is applied to the heating elements 105. Such heating elements 105 are preferably designed as resistance heating elements.

If the paper sensor 120 is configured as a laser scanner capable of reading bar codes, and if markings are applied to the labels in the form of bar codes which provide information on the type of paper used for the labels, the operation of the thermal printer 101 can essentially be automated because the type of paper for the labels need no longer be input manually by the operator, but the processor 104, by means of the paper sensor 120, can automatically identify which type of labels have been inserted. On the basis of the data received in this manner, the processor 104 retrieves the corresponding data matrix from the second memory area 127 of the read/write memory 125, and the ink ribbon data specified for the type of paper identified from the fourth memory area 129. Using these data, the thermal printer 101 can be controlled by the processor 104 as described above.

One feature of the invention resides broadly in a printer with a pressure roller 3, and corresponding to it a print head 4 which has a support 5 which can be pressed against the pressure roller 3 and also has a spring base plate 6, whereby there is at least one compression spring 7 between the spring base plate 6 and the support 5, at least the spring base plate 6 is rotationally mounted on a bearing shaft 2 which is preferably oriented parallel to the pressure roller 3, and a locking element 12 which is torsionally, or dynamometrically, connected to the bearing shaft 2 is engaged in its locking position in a latching locator 20 on the spring base plate 6, characterized by the fact that the free end of the bearing shaft 2 is flattened over a portion of its length to form two parallel key surfaces 13, 14, and that the locking element 12 has a keyhole-like opening 18, the circular portion 21 of which has a diameter which is approximately equal to the diameter of the free end of the bearing shaft 2, while the width of the narrow portion 22 of the opening approximately equals the distance between the key surfaces 13, 14.

Another feature of the invention resides broadly in the printer characterized by the fact that the thickness of the locking element 12, at least in the vicinity of the opening 18, approximately equals the partial length of the bearing shaft 2 with the key surfaces 13, 14.

Yet another feature of the invention resides broadly in the printer characterized by the fact that fastened to the free end of the bearing shaft 2 there is an azimuthally adjustable adjusting piece, on which the key surfaces 13, 14 are located.

Still another feature of the invention resides broadly in the printer characterized by the fact that the adjusting piece is an adjusting shaft 11 which is centrally connected to the free end of the bearing shaft 2 and can be loosened and fastened in place.

A further feature of the invention resides broadly in the printer characterized by the fact that the locking element 12 has at least one locking projection 19 which projects at right angles to its plane, and which is engaged in the locking position in a groove-shaped latching locator 20 on the spring base plate 6.

Another feature of the invention resides broadly in the printer characterized by the fact that the adjusting shaft 11 with a centering pin 25 is engaged in an axial blind hole 26 on the free end of the bearing shaft, and that It is penetrated axially by a fastening screw 15 which is screwed into a threaded hole 27 in the base of the blind hole 26.

Yet another feature of the invention resides broadly in the printer characterized by the fact that on the free end of the bearing shaft 2 or of the adjusting piece there is an external groove 31, which locates the hook-like free end 34 of a fastener 35 which is mounted or connected so that it can pivot on the frame 1 or housing of the printer.

Still another feature of the invention resides broadly in the printer characterized by the fact that the fastener 35 is mounted on a cam 44 so that it can be pivoted and adjusted.

A further feature of the invention resides broadly in the printer characterized by the fact that the locking element 12 has at least two locking projections 19, **19*a* offset from one another at an angle, whereby the vertex of this angle corresponds to the geometric axis of the circular portion 21 of the opening, and that there is a narrow portion 22, 22*a* of the opening corresponding to each locking projection 19, 19*a***.

Another feature of the invention resides broadly in the printer characterized by the fact that the two locking projections 19, **19*a* point in opposite directions, whereby the one is oriented symmetrically with respect to a plane of symmetry 23 through the two narrow portions 22, 22*a* of the opening and the other is laterally offset somewhat in relation to the plane of symmetry 23**.

Yet another feature of the invention resides broadly in the printer characterized by the fact that there is a preferably corrugated or similarly non-slip push-button 42, 43 offset by approximately 180 degrees from each locking projection 19, **19*a***.

Still another feature of the invention resides broadly in the printer characterized by the fact that the groove-shaped latching locator 20 for the locking projection 19 is located on a strip-shaped, longitudinal extension 38 of the sleeve-like extension 8 of the spring base plate 6.

A further feature of the invention resides broadly in the printer characterized by the fact that when the spring base plate 6 is pivoted up, the locking projection 19, **19*a* of the locking element 12 is engaged externally behind the longitudinal extension 38 of the spring base plate 6**.

Some examples of printers, and components thereof, which could be utilized in conjunction with the present invention are disclosed by the following U.S. patents:

Some types of printers and the various components thereof which could be used in conjunction with the present invention are disclosed by the following U.S. patents, U.S. Pat. No. 5,160,943 to Pettigrew et al., entitled "Printing Systems"; U.S. Pat. No. 5,055,858 to Koch, entitled "Thermal Print Head"; U.S. Pat. No. 5,023,628 to Koch, entitled "Thermal Head Mounting/Positioning Assembly"; U.S. Pat. No. 5,165,806 to Collins, entitled "Thermal Printer with Movable Drive Roll"; U.S. Pat. No. 4,326,813 to Lomicka and Heller, entitled "Dot Matrix Character Printer Control Circuitry for Variable Pitch Printing"; U.S. Pat. No. 4,214,836 to Wang, entitled "Impact Print Head"; and U.S. Pat. No. 4,300,844.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 32 602.1, filed on Sep. 24, 1993, having inventors Ulf Koch and Peter Schneider, and DE-OS P 43 32 602.1 and DE-PS P 43 32 602.1, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A label printer for printing labels on a label material, said label printer comprising:

means for storing label material to be printed upon;

at least one printing element, said at least one printing element comprising means for printing on the label material;

surface means disposed adjacent said at least one printing element;

biasing means for applying a force to said at least one printing element for biasing said at least one printing element into engagement with said surface means;

means for feeding label material from said means for storing label material to an area between said at least one printing element and said surface means;

means for actuating said at least one printing element to print on the label material between said at least one printing element and said surface means;

means for positioning said biasing means relative to said at least one printing element;

means for adjusting said means for positioning, said means for adjusting comprising at least first and second positions for moving said biasing means between at least first and second positions;

said biasing means in said first position applying a first biasing force to said at least one printing element, and said biasing means in said second position applying a second biasing force to said at least one printing element;

said second biasing force being greater than said first biasing force;

means for locking said means for adjusting in at least said first and second positions;

said label printer further comprising bearing shaft means;

said bearing shaft means having a longitudinal axis;

means for mounting said biasing means;

means for pivotably mounting said print head; and said means for mounting said biasing means and said means for pivotably mounting said print head being disposed on said bearing shaft means.

2. The label printer according to claim 1, wherein:

said pressure roller defining a longitudinal axis, and said biasing means for biasing said at least one printing element towards said pressure roller;

said label printer further comprises:

a print head, said print head comprising said at least one printing element; and means for pivotably mounting said print head within said label printer for movement of said print head towards and away from said pressure roller; and said means for positioning said biasing means comprises means for mounting said biasing means within said label printer for movement of said biasing means between at least said first and second positions.

3. The label printer according to claim 2, wherein:

said surface means comprises a pressure roller disposed adjacent said at least one printing element; and said longitudinal axis of said bearing shaft means being substantially parallel to said longitudinal axis of said pressure roller.

4. The label printer according to claim 3, wherein:

said means for pivotably mounting said print head comprises a first cylindrical portion disposed about said bearing shaft means and a first arm portion extending away from said bearing shaft means;

said means for mounting said biasing means comprises a second cylindrical portion disposed about said first cylindrical portion of said means for pivotably mounting said print head and a second arm portion extending away from said bearing shaft means;

said biasing means being disposed between said first arm portion of said means for pivotably mounting said print head and said second arm portion of said means for mounting said biasing means;

said second cylindrical portion of said means for mounting said biasing means comprises means for engaging said means for adjusting;

said first position of said means for adjusting being for positioning said second arm portion at a first distance from said pressure roller to compress said biasing means a first amount between said first arm portion and said second arm portion;

said second position of said means for adjusting being for positioning said second arm portion at a second distance from said pressure roller to compress said biasing means a second amount between said first arm portion and said second arm portion;

said second distance being less than said first distance, wherein said second amount of compressing is greater than said first amount of compressing to provide said second biasing force said bearing shaft means has a diameter; greater than said first biasing force;

said bearing shaft means has a first end for mounting said bearing shaft means within the label printer, and a second end opposite the first end, said second end of said bearing shaft means comprising two substantially parallel flat surfaces, said two substantially parallel flat surfaces being disposed on said bearing shaft means to face in opposite directions from one another and defining a distance therebetween;

said means for adjusting comprises a passage therethrough, said passage of said means for adjusting comprising a first passage portion and at least two second passage portions;

said first passage portion being substantially circular with a diameter essentially equal to the diameter of said bearing shaft means;

said at least two second passage portions extend from said first passage portion, and each of said at least two second passage portions comprise two substantially parallel flat surfaces disposed at a distance from one another, said distance between said two substantially parallel surfaces of each of said at least two second passage, portions corresponding to said distance between said two substantially parallel surfaces of said bearing shaft means;

said substantially parallel surfaces of one of said at least two second passage portions being disposed angularly with respect to said substantially parallel surfaces of others of said at least two second passage portions;

one of said at least two second passage portions corresponding to said first position of said means for adjusting, and another of said at least two second passage portions corresponding to said second position of said means for adjusting;

said means for non-rotationally mounting said means for adjusting to said bearing shaft means comprises said two substantially parallel surfaces of said bearing shaft means and said two substantially parallel surfaces of any of said at least two second passage portions;

said means for adjusting, with said first passage portion disposed about said bearing shaft means, being rotatable on said bearing shaft means to align said at least two parallel surfaces of one of said at least two second passage portions with said at least two parallel surfaces of said bearing shaft means;

said means for adjusting being slidable in a direction parallel to said aligned parallel surfaces to lock said means for adjusting in one of said first and second positions;

said bearing shaft means comprises a first shaft portion and a second shaft portion;

said first shaft portion comprises said first end of said bearing shaft means, and said first shaft portion being non-rotationally fixed within said label printer;

said second shaft portion comprises said second end of said bearing shaft means, said second shaft portion comprises said two substantially parallel surfaces of said bearing shaft means, and said second shaft portion being rotatable with respect to said first shaft portion for variably positioning said two substantially parallel surfaces;

said bearing shaft means further comprises means for non-rotationally fastening said second shaft portion to said first shaft portion for fixing said two substantially parallel surfaces in a predetermined position with respect to said first shaft portion;

said means for adjusting comprises a substantially planar element, said means for locking comprises at least first and second projections extending substantially perpendicularly from said planar element, each of said at least two second passage portions having a corresponding one of said at least first and second projections associated therewith, said planar element defining a plane, and said planar element for being positioned on said bearing shaft means with said plane thereof substantially perpendicular to said longitudinal axis of said bearing shaft means, and with said projections disposed substantially parallel to said longitudinal axis of said bearing shaft means;

said second cylindrical portion has a first end adjacent said first end of said bearing shaft means and a second end adjacent said second end of said bearing shaft means, said second end comprises a notch for receiving said projections of said portion with said planar element; planar element therein for locking said second cylindrical said first shaft portion comprises a first end, and a second end disposed adjacent said second shaft portion, said second end comprises a blind hole disposed axially therein;

said second shaft portion comprises a first end for being disposed in said blind hole of said first shaft portion;

said means for non-rotationally fastening said second shaft portion to said first shaft portion comprises screw means for being disposed axially through said second shaft portion and threaded into said first shaft portion;

said second shaft portion comprises a second end, said second end comprises an external circumferential groove disposed therearound;

said label printer further comprises lever means pivotable into engagement with said external circumferential groove to stabilize and position said second end of said bearing shaft means;

said label printer further comprises means for adjusting a position of said lever means to adjust a position of said second end of said bearing shaft means and maintain said bearing shaft means parallel to said pressure roller;

said two substantially parallel surfaces of each of said at least two second passage portions define a longitudinal central axis therebetween;

said projection corresponding to one of said second passage portions being disposed in alignment with said longitudinal central axis of said one of said second passage portions;

said projection corresponding to another of said second passage portions being disposed offset from said longitudinal central axis of said another of said second passage portions, said offset being in a direction towards said print head to reduce the distance between said first arm portion and said second arm portion;

said second cylindrical portion comprises a longitudinal projection extending radially away from said second cylindrical portion;

said longitudinal projection comprises said notch for engaging said projections of said means for adjusting;

said longitudinal projection comprises a first edge disposed towards said second arm portion;

said second cylindrical portion is pivotable about said bearing shaft means to pivot said second arm portion away from said pressure roller;

said projections of said means for adjusting being configured for engaging said first edge of said longitudinal projection upon pivoting of said second arm portion away from said pressure roller to retain said second arm portion pivoted away from said pressure roller;

said at least two second passage portions are disposed at about 90 degrees with respect to one another;

said projection corresponding to said one of said second passage portions and said projection corresponding to said another of said second passage portions being disposed at about 85 degrees with respect to one another;

said means for adjusting comprises a surface corresponding to each of said second passage portions, said surface being disposed about said first passage portion and opposite each of said second passage portions;

said surface comprising a non-slip surface for being pressed upon to slide said means for adjusting in a direction parallel to said two substantially parallel surfaces of said bearing shaft means to align said bearing shaft means with said first passage portion;

said means for adjusting being removable from said bearing shaft means with said first passage portion aligned with said bearing shaft means;

said label printer comprises a thermal printer;

said at least one printing element comprises a plurality of thermal printing elements, said thermal printing elements being heatable to print on said label material;

said means for adjusting further comprises block means for blocking alignment of said first passage portion with said bearing shaft means to prevent accidental removal of said means for adjusting from said bearing shaft means;

said means for adjusting a position of said lever means comprises cam means for mounting said lever means within said label printer;

said first portion of said bearing shaft means has a length;

said first portion of said bearing shaft means comprises a central portion between said first and second ends of said first portion of said bearing shaft means;

said central portion comprising a substantial portion of the length of said first portion of said bearing shaft means; and said central portion having a diameter less than said diameter of said bearing shaft means to reduce friction between said bearing shaft means and said first cylindrical portion of said means for pivotably mounting said print head.

5. The label printer according to claim 1, wherein:

said means for pivotably mounting said print head comprises a first cylindrical portion disposed about said bearing shaft means and a first arm portion extending away from said bearing shaft means; and said means for mounting said biasing means comprises a second cylindrical portion disposed about said first cylindrical portion of said means for pivotably mounting said print head and a second arm portion extending away from said bearing shaft means.

6. The label printer according to claim 5, wherein said biasing means comprising a compression spring disposed to be compressed between said first arm portion and said second arm portion.

7. The label printer according to claim 6, wherein:

said first position of said means for adjusting being for positioning said second arm portion at a first distance from said pressure roller to compress said biasing means a first amount between said first arm portion and said second arm portion;

said second position of said means for adjusting being for positioning said second arm portion at a second distance from said pressure roller to compress said biasing means a second amount between said first arm portion and said second arm portion; and said second distance being less than said first distance, wherein said second amount of compressing is greater than said first amount of compressing to provide said second biasing force greater than said first biasing force.

8. The label printer according to claim 7, wherein:

said means for pivotably mounting said print head comprises a first cylindrical portion disposed about said bearing shaft means and a first arm portion extending away from said bearing shaft means;

said means for mounting said biasing means comprises a second cylindrical portion disposed about said first cylindrical portion of said means for pivotably mounting said print head and a second arm portion extending away from said bearing shaft means;

said biasing means being disposed between said first arm portion of said means for pivotably mounting said print head and said second arm portion of said means for mounting said biasing means;

said second cylindrical portion of said means for mounting said biasing means comprises means for engaging said means for adjusting;

said first position of said means for adjusting being for positioning said second arm portion at a first distance from said pressure roller to compress said biasing means a first amount between said first arm portion and said second arm portion;

said second position of said means for adjusting being for positioning said second arm portion at a second distance from said pressure roller to compress said biasing means a second amount between said first arm portion and said second arm portion;

said second distance being less than said first distance, wherein said second amount of compressing is greater than said first amount of compressing to provide said second biasing force greater than said first biasing force;

said bearing shaft means has a diameter;

said bearing shaft means has a first end for mounting said bearing shaft means within the label printer, and a second end opposite the first end, said second end of said bearing shaft means comprising two substantially parallel flat surfaces, said two substantially parallel flat surfaces being disposed on said bearing shaft means to face in opposite directions from one another and defining a distance therebetween;

said means for adjusting comprises a passage therethrough, said passage of said means for adjusting comprising a first passage portion and at least two second passage portions;

said first passage portion being substantially circular with a diameter essentially equal to the diameter of said bearing shaft means;

said at least two second passage portions extend from said first passage portion, and each of said at least two second passage portions comprise two substantially parallel flat surfaces disposed at a distance from one another, said distance between said two substantially parallel surfaces of each of said at least two second passage portions corresponding to said distance between said two substantially parallel surfaces of said bearing shaft means;

said substantially parallel surfaces of one of said at least two second passage portions being disposed angularly with respect to said substantially parallel surfaces of others of said at least two second passage portions;

one of said at least two second passage portions corresponding to said first position of said means for adjusting, and another of said at least two second passage portions corresponding to said second position of said means for adjusting;

said means for non-rotationally mounting said means for adjusting to said bearing shaft means comprises said two substantially parallel surfaces of said bearing shaft means and said two substantially parallel surfaces of any of said at least two second passage portions;

said means for adjusting, with said first passage portion disposed about said bearing shaft means, being rotatable on said bearing shaft means to align said at least two parallel surfaces of one of said at least two second passage portions with said at least two parallel surfaces of said bearing shaft means;

said means for adjusting being slidable in a direction parallel to said aligned parallel surfaces to lock said means for adjusting in one of said first and second positions;

said bearing shaft means comprises a first shaft portion and a second shaft portion;

said first shaft portion comprises said first end of said bearing shaft means, and said first shaft portion being non-rotationally fixed within said label printer;

said second shaft portion comprises said second end of said bearing shaft means, said second shaft portion comprises said two substantially parallel surfaces of said bearing shaft means, and said second shaft portion being rotatable with respect to said first shaft portion for variably positioning said two substantially parallel surfaces;

said bearing shaft means further comprises means for non-rotationally fastening said second shaft portion to said first shaft portion for fixing said two substantially parallel surfaces in a predetermined position with respect to said first shaft portion;

said means for adjusting comprises a substantially planar element, said means for locking comprises at least first and second projections extending substantially perpendicularly from said planar element, each of said at least two second passage portions having a corresponding one of said at least first and second projections associated therewith, said planar element defining a plane, and said planar element for being positioned on said bearing shaft means with said plane thereof substantially perpendicular to said longitudinal axis of said bearing shaft means, and with said projections disposed substantially parallel to said longitudinal axis of said bearing shaft means;

said second cylindrical portion has a first end adjacent said first end of said bearing shaft means and a second end adjacent said second end of said bearing shaft means, said second end comprises a notch for receiving said projections of said planar element therein for locking said second cylindrical portion with said planar element;

said first shaft portion comprises a first end, and a second end disposed adjacent said second shaft portion, said second end comprises a blind hole disposed axially therein;

said second shaft portion comprises a first end for being disposed in said blind hole of said first shaft portion;

said means for non-rotationally fastening said second shaft portion to said first shaft portion comprises screw means for being disposed axially through said second shaft portion and threaded into said first shaft portion;

said second shaft portion comprises a second end, said second end comprises an external circumferential groove disposed therearound;

said label printer further comprises lever means pivotable into engagement with said external circumferential groove to stabilize and position said second end of said bearing shaft means;

said label printer further comprises means for adjusting a position of said lever means to adjust a position of said second end of said bearing shaft means and maintain said bearing shaft means parallel to said pressure roller;

said two substantially parallel surfaces of each of said at least two second passage portions define a longitudinal central axis therebetween;

said projection corresponding to one of said second passage portions being disposed in alignment with said longitudinal central axis of said one of said second passage portions;

said projection corresponding to another of said second passage portions being disposed offset from said longitudinal central axis of said another of said second passage portions, said offset being in a direction towards said print head to reduce the distance between said first arm portion and said second arm portion;

said second cylindrical portion comprises a longitudinal projection extending radially away from said second cylindrical portion;

said longitudinal projection comprises said notch for engaging said projections of said means for adjusting;

said longitudinal projection comprises a first edge disposed towards said second arm portion;

said second cylindrical portion is pivotable about said bearing shaft means to pivot said second arm portion away from said pressure roller;

said projections of said means for adjusting being configured for engaging said first edge of said longitudinal projection upon pivoting of said second arm portion away from said pressure roller to retain said second arm portion pivoted away from said pressure roller;

said at least two second passage portions are disposed at about 90 degrees with respect to one another;

said projection corresponding to said one of said second passage portions and said projection corresponding to said another of said second passage portions being disposed at about 85 degrees with respect to one another;

said means for adjusting comprises a surface corresponding to each of said second passage portions, said surface being disposed about said first passage portion and opposite each of said second-passage portions;

said surface comprising a non-slip surface for being pressed upon to slide said means for adjusting in a direction parallel to said two substantially parallel surfaces of said bearing shaft means to align said bearing shaft means with said first passage portion;

said means for adjusting being removable from said bearing shaft means with said first passage portion aligned with said bearing shaft means;

said label printer comprises a thermal printer;

said at least one printing element comprises a plurality of thermal printing elements, said thermal printing elements being heatable to print on said label material;

said means for adjusting further comprises block means for blocking alignment of said first passage portion with said bearing shaft means to prevent accidental removal of said means for adjusting from said bearing shaft means;

said means for adjusting a position of said lever means comprises cam means for mounting said lever means within said label printer;

said first portion of said bearing shaft means has a length;

said first portion of said bearing shaft means comprises a central portion between said first and second ends of said first portion of said bearing shaft means;

said central portion comprising a substantial portion of the length of said first portion of said bearing shaft means; and said central portion having a diameter less than said diameter of said bearing shaft means to reduce friction between said bearing shaft means and said first cylindrical portion of said means for pivotably mounting said print head.

9. A printer for printing on a material, said printer comprising: at least one printing element for printing on the material; biasing means for applying a force to said at least one printing element for biasing said at least one printing element into engagement with the material for printing on the material; and means for actuating said at least one printing element to print on the material; with a kit for varying the biasing force of said biasing means, said kit comprising:

at least a first interchangeable element for positioning said biasing means in a first position within said printer, said biasing means in said first position applying a first biasing force on said at least one printing element;

at least a second interchangeable element for positioning said biasing means in a second position within said printer, said biasing means in said second position applying a second biasing force on said at least one printing element;

said second biasing force being greater than said first biasing force;

said first interchangeable element and said second interchangeable element being positionally interchangeable within said printer for moving said biasing means between said first and second positions;

said printer further comprising bearing shaft means, said bearing shaft means comprising elongated bearing shaft means;

said elongated bearing shaft means having a longitudinal axis; and said means for mounting said biasing means and said means for pivotably mounting said print head being disposed on said bearing shaft means.

10. The printer according to claim 9, wherein: said printer further comprises:

a print head, said print head comprising said at least one printing element;

a pressure roller disposed adjacent said at least one printing element, said pressure roller defining a longitudinal axis, said biasing means for biasing said at least one printing element towards said pressure roller;

means for pivotably mounting said print head within said printer for movement of said print head towards and away from said pressure roller; and means for mounting said biasing means within said printer for movement of said biasing means between at least said first and second positions; and said first and second interchangeable elements comprising means for locking said means for mounting said biasing means in first and second positions corresponding to first and second positions of said biasing means.

11. The printer according to claim 10, wherein:

said printer comprises a printer for printing on label material, and the material comprises a label material; and said longitudinal axis of said bearing shaft means being substantially parallel to said longitudinal axis of said pressure roller.

12. The printer according to claim 11, wherein:

said means for pivotably mounting said print head comprises a first cylindrical portion disposed about said bearing shaft means and a first arm portion extending away from said bearing shaft means;

said means for mounting said biasing means comprises a second cylindrical portion disposed about said first cylindrical portion of said means for pivotably mounting said print head and a second arm portion extending away from said bearing shaft means;

said biasing means being disposed between said first arm portion of said means for pivotably mounting said print head and said second arm portion of said means for mounting said biasing means;

said second cylindrical portion of said means for mounting said biasing means comprises means for engaging said lock means of one of said non-rotationally mounted first and second interchangeable elements;

said first position of said means for mounting said biasing means comprises said second arm portion disposed at a first distance from said pressure roller to compress said biasing means a first amount between said first arm portion and said second arm portion;

said second position of said means for mounting said biasing means comprises said second arm portion disposed at a second distance from said pressure roller to compress said biasing means a second amount between said first arm portion and said second arm portion;

said second distance being less than said first distance, and said second amount of compression being greater than said first amount of compression to provide said second biasing force greater than said first biasing force;

said bearing shaft means has a diameter;

said bearing shaft means has a first end for mounting said bearing shaft means within the printer, and a second end opposite the first end, said second end of said bearing shaft means comprising two substantially parallel flat surfaces, said two substantially parallel flat surfaces being disposed on said bearing shaft means to face in opposite directions from one another and defining a distance therebetween;

said first and second interchangeable elements each comprise a passage therethrough, said passage of each of said first and second interchangeable elements comprising a first passage portion and a second passage portion;

said first passage portion being substantially circular with a diameter essentially equal to the diameter of said bearing shaft means;

said second passage portion extending from said first passage portion and comprising two substantially parallel flat surfaces disposed at a distance from one another, said distance between said two substantially parallel surfaces of said second passage portion corresponding to said distance between said two substantially parallel surfaces of said bearing shaft means;

said means for non-rotationally mounting said first and second interchangeable elements to said bearing shaft means comprises said two substantially parallel surfaces of said bearing shaft means and said two substantially parallel surfaces of said second passage portion;

said bearing shaft means comprises a first shaft portion and a second shaft portion;

said first shaft portion comprises said first end of said bearing shaft means, and said first shaft portion being non-rotationally fixed within said printer;

said second shaft portion comprises said second end of said bearing shaft means, said second shaft portion comprises said two substantially parallel surfaces of said bearing shaft means, and said second shaft portion being rotatable with respect to said first shaft portion for variably positioning said two substantially parallel surfaces;

said bearing shaft means further comprises means for non-rotationally fastening said second shaft portion to said first shaft portion for fixing said two substantially parallel surfaces in a predetermined position with respect to said first shaft portion;

said first and second interchangeable elements each comprise a substantially planar element, said means for locking comprise projections extending substantially perpendicularly from each said planar element, each said planar element defining a plane, and said planar elements for being positioned on said bearing shaft means with said plane thereof substantially perpendicular to said longitudinal axis of said bearing shaft means, and with said projections disposed substantially parallel to said longitudinal axis of said bearing shaft means;

said second cylindrical portion has a first end adjacent said first end of said bearing shaft means and a second end adjacent said second end of said bearing shaft means, said second end comprises a notch for receiving said projection of said planar element therein for locking said second cylindrical portion with said planar element;

said first shaft portion comprises a first end, and a second end disposed adjacent said second shaft portion, said second end comprises a blind hole disposed axially therein;

said second shaft portion comprises a first end for being disposed in said blind hole of said first shaft portion;

said means for non-rotationally fastening said second shaft portion to said first shaft portion comprises screw means for being disposed axially through said second shaft portion and threaded into said first shaft portion;

said second shaft portion comprises a second end, said second end comprises an external circumferential groove disposed therearound;

said printer further comprises lever means pivotable into engagement with said external circumferential groove to stabilize and position said second end of said bearing shaft means;

said printer further comprises means for adjusting a position of said lever means to adjust a position of said second end of said bearing shaft means and maintain said bearing shaft means parallel to said pressure roller;

said two substantially parallel surfaces of each of said first and second interchangeable element define a longitudinal central axis therebetween;

said projection of said first interchangeable element being disposed in alignment with said longitudinal central axis of said first interchangeable element;

said projection of said second interchangeable element being disposed offset from said longitudinal central axis of said second interchangeable element, said offset being in a direction towards said print head to reduce the distance between said first arm portion and said second arm portion;

said second cylindrical portion comprises a longitudinal projection extending radially away from said second cylindrical portion;

said longitudinal projection comprises said notch for engaging said projections of said first and second interchangeable member;

said longitudinal projection comprises a first edge disposed towards said second arm portion;

said second cylindrical portion is pivotable about said bearing shaft means to pivot said second arm portion away from said pressure roller; and said projection of said first and second interchangeable elements is configured for engaging said first edge of said longitudinal projection upon pivoting of said second arm portion away from said pressure roller to retain said second arm portion pivoted away from said pressure roller.

13. The label printer according to claim 9, wherein:

said means for pivotably mounting said print head comprises a first cylindrical portion disposed about said bearing shaft means and a first arm portion extending away from said bearing shaft means; and said means for mounting said biasing means comprises a second cylindrical portion disposed about said first cylindrical portion of said means for pivotably mounting said print head and a second arm portion extending away from said bearing shaft means.

14. The label printer according to claim 13, wherein said biasing means comprising a compression spring disposed to be compressed between said first arm portion and said second arm portion.

15. The label printer according to claim 14, wherein:

said first position of said means for adjusting being for positioning said second arm portion at a first distance from said pressure roller to compress said biasing means a first amount between said first arm portion and said second arm portion;

said second position of said means for adjusting being for positioning said second arm portion at a second distance from said pressure roller to compress said biasing means a second amount between said first arm portion and said second arm portion; and said second distance being less than said first distance, wherein said second amount of compressing is greater than said first amount of compressing to provide said second biasing force greater than said first biasing force.

16. The label printer according to claim 15, wherein:

said means for pivotably mounting said print head comprises a first cylindrical portion disposed about said bearing shaft means and a first arm portion extending away from said bearing shaft means;

said means for mounting said biasing means comprises a second cylindrical portion disposed about said first cylindrical portion of said means for pivotably mounting said print head and a second arm portion extending away from said bearing shaft means;

said biasing means being disposed between said first arm portion of said means for pivotably mounting said print head and said second arm portion of said means for mounting said biasing means;

said second cylindrical portion of said means for mounting said biasing means comprises means for engaging said means for adjusting;

said first position of said means for adjusting being for positioning said second arm portion at a first distance from said pressure roller to compress said biasing means a first amount between said first arm portion and said second arm portion;

said second position of said means for adjusting being for positioning said second arm portion at a second distance from said pressure roller to compress said biasing means a second amount between said first arm portion and said second arm portion;

said second distance being less than said first distance, wherein said second amount of compressing is greater than said first amount of compressing to provide said second biasing force greater than said first biasing force;

said bearing shaft means has a diameter;

said bearing shaft means has a first end for mounting said bearing shaft means within the label printer, and a second end opposite the first end, said second end of said bearing shaft means comprising two substantially parallel flat surfaces, said two substantially parallel flat surfaces being disposed on said bearing shaft means to face in opposite directions from one another and defining a distance therebetween;

said means for adjusting comprises a passage therethrough, said passage of said means for adjusting comprising a first passage portion and at least two second passage portions;

said first passage portion being substantially circular with a diameter essentially equal to the diameter of said bearing shaft means;

said at least two second passage portions extend from said first passage portion, and each of said at least two second passage portions comprise two substantially parallel flat surfaces disposed at a distance from one another, said distance between said two substantially parallel surfaces of each of said at least two second passage portions corresponding to said distance between said two substantially parallel surfaces of said bearing shaft means;

said substantially parallel surfaces of one of said at least two second passage portions being disposed angularly with respect to said substantially parallel surfaces of others of said at least two second passage portions;

one of said at least two second passage portions corresponding to said first position of said means for adjusting, and another of said at least two second passage portions corresponding to said second position of said means for adjusting;

said means for non-rotationally mounting said means for adjusting to said bearing shaft means comprises said two substantially parallel surfaces of said bearing shaft means and said two substantially parallel surfaces of any of said at least two second passage portions;

said means for adjusting, with said first passage portion disposed about said bearing shaft means, being rotatable on said bearing shaft means to align said at least two parallel surfaces of one of said at least two second passage portions with said at least two parallel surfaces of said bearing shaft means;

said means for adjusting being slidable in a direction parallel to said aligned parallel surfaces to lock said means for adjusting in one of said first and second positions;

said bearing shaft means comprises a first shaft portion and a second shaft portion;

said first shaft portion comprises said first end of said bearing shaft means, and said first shaft portion being non-rotationally fixed within said label printer;

said second shaft portion comprises said second end of said bearing shaft means, said second shaft portion comprises said two substantially parallel surfaces of said bearing shaft means, and said second shaft portion being rotatable with respect to said first shaft portion for variably positioning said two substantially parallel surfaces;

said bearing shaft means further comprises means for non-rotationally fastening said second shaft portion to said first shaft portion for fixing said two substantially parallel surfaces in a predetermined position with respect to said first shaft portion;

said means for adjusting comprises a substantially planar element, said means for locking comprises at least first and second projections extending substantially perpendicularly from said planar element, each of said at least two second passage portions having a corresponding one of said at least first and second projections associated therewith, said planar element defining a plane, and said planar element for being positioned on said bearing shaft means with said plane thereof substantially perpendicular to said longitudinal axis of said bearing shaft means, and with said projections disposed substantially parallel to said longitudinal axis of said bearing shaft means;

said second cylindrical portion has a first end adjacent said first end of said bearing shaft means and a second end adjacent said second end of said bearing shaft means, said second end comprises a notch for receiving said projections of said planar element therein for locking said second cylindrical portion with said planar element;

said first shaft portion comprises a first end, and a second end disposed adjacent said second shaft portion, said second end comprises a blind hole disposed axially therein;

said second shaft portion comprises a first end for being disposed in said blind hole of said first shaft portion;

said means for non-rotationally fastening said second shaft portion to said first shaft portion comprises screw means for being disposed axially through said second shaft portion and threaded into said first shaft portion;

said second shaft portion comprises a second end, said second end comprises an external circumferential groove disposed therearound;

said label printer further comprises lever means pivotable into engagement with said external circumferential groove to stabilize and position said second end of said bearing shaft means;

said label printer further comprises means for adjusting a position of said lever means to adjust a position of said second end of said bearing shaft means and maintain said bearing shaft means parallel to said pressure roller;

said two substantially parallel surfaces of each of said at least two second passage portions define a longitudinal central axis therebetween;

said projection corresponding to one of said second passage portions being disposed in alignment with said longitudinal central axis of said one of said second passage portions;

said projection corresponding to another of said second passage portions being disposed offset from said longitudinal central axis of said another of said second passage portions, said offset being in a direction towards said print head to reduce the distance between said first arm portion and said second arm portion;

said second cylindrical portion comprises a longitudinal projection extending radially away from said second cylindrical portion;

said longitudinal projection comprises said notch for engaging said projections of said means for adjusting;

said longitudinal projection comprises a first edge disposed towards said second arm portion;

said second cylindrical portion is pivotable about said bearing shaft means to pivot said second arm portion away from said pressure roller;

said projections of said means for adjusting being configured for engaging said first edge of said longitudinal projection upon pivoting of said second arm portion away from said pressure roller to retain said second arm portion pivoted away from said pressure roller;

said at least two second passage portions are disposed at about 90 degrees with respect to one another;

said projection corresponding to said one of said second passage portions and said projection corresponding to said another of said second passage portions being disposed at about 85 degrees with respect to one another;

said means for adjusting comprises a surface corresponding to each of said second passage portions, said surface being disposed about said first passage portion and opposite each of said second passage portions;

said surface comprising a non-slip surface for being pressed upon to slide said means for adjusting in a direction parallel to said two substantially parallel surfaces of said bearing shaft means to align said bearing shaft means with said first passage portion;

said means for adjusting being removable from said bearing shaft means with said first passage portion aligned with said bearing shaft means;

said label printer comprises a thermal printer;

said at least one printing element comprises a plurality of thermal printing elements, said thermal printing elements being heatable to print on said label material;

said means for adjusting further comprises block means for blocking alignment of said first passage portion with said bearing shaft means to prevent accidental removal of said means for adjusting from said bearing shaft means; said means for adjusting a position of said lever means comprises cam means for mounting said lever means within said label printer;

said first portion of said bearing shaft means has a length;

said first portion of said bearing shaft means comprises a central portion between said first and second ends of said first portion of said bearing shaft means;

said central portion comprising a substantial portion of the length of said first portion of said bearing shaft means; and said central portion having a diameter less than said diameter of said bearing shaft means to reduce friction between said bearing shaft means and said first cylindrical portion of said means for pivotably mounting said print head.

17. A printer for printing on a material, said printer comprising:

means for storing material to be printed upon;

at least one printing element, said at least one printing element comprising means for printing on the material;

surface means disposed adjacent said at least one printing element;

biasing means for applying a force to said at least one printing element for biasing said at least one printing element into engagement with said surface means;

means for feeding material to be printed upon from said means for storing material to an area between said at least one printing element and said surface means;

means for actuating said at least one printing element to print on the material between said at least one printing element and said surface means;

means for positioning said biasing means relative to said at least one printing element;

means for adjusting said means for positioning, said means for adjusting comprising at least first and second positions for moving said biasing means between at least first and second positions;

said biasing mean in said first position applying a first biasing force to said at least one printing element, and said biasing means in said second position applying a second biasing force to said at least one printing element;

said second biasing force being greater than said first biasing force;

means for locking said means for adjusting in at least said first and second positions;

said printer comprises a thermal printer, said at least one printing element comprises at least one thermal printing element, and said means for actuating said at least one printing element comprises means for thermally heating said at least one printing element to print on the label material;

said printer further comprising bearing shaft means, said bearing shaft means comprising elongated bearing shaft means;

said elongated bearing shaft means having a longitudinal axis; and said means for mounting said biasing means and said means for pivotably mounting said print head being disposed on said bearing shaft means.

18. The printer according to claim 17, wherein:

said printer comprises a printer for printing on a label material, and said material comprises a label material;

said surface means comprises a pressure roller disposed adjacent said at least one printing element, said pressure roller defining a longitudinal axis, and said biasing means for biasing said at least one printing element towards said pressure roller;

said printer further comprises: a print head, said print head comprising said at least one printing element; and means for pivotably mounting said print head within said printer for movement of said print head towards and away from said pressure roller;

said means for positioning said biasing means comprises means for mounting said biasing means within said printer for movement of said biasing means between at least said first and second positions;

said longitudinal axis of said bearing shaft means being substantially parallel to said longitudinal axis of said pressure roller;

said means for pivotably mounting said print head comprises a first cylindrical portion disposed about said bearing shaft means and a first arm portion extending away from said bearing shaft means;

said means for mounting said biasing means comprises a second cylindrical portion disposed about said first cylindrical portion of said means for pivotably mounting said print head and a second arm portion extending away from said bearing shaft means;

said biasing means being disposed between said first arm portion of said means for pivotably mounting said print head and said second arm portion of said means for mounting said biasing means;

said second cylindrical portion of said means for mounting said biasing means comprises means for engaging said means for adjusting;

said first position of said means for adjusting being for positioning said second arm portion at a first distance from said pressure roller to compress said biasing means a first amount between said first arm portion and said second arm portion;

said second position of said means for adjusting being for positioning said second arm portion at a second distance from said pressure roller to compress said biasing means a second amount between said first arm portion and said second arm portion;

said second distance being less than said first distance, wherein said second amount of compressing is greater than said first amount of compression to provide said second biasing force greater than said first biasing force;

said bearing shaft means has a diameter;

said bearing shaft means has a first end for mounting said bearing shaft means within the printer, and a second end opposite the first end, said second end of said bearing shaft means comprising two substantially parallel flat surfaces, said two substantially parallel flat surfaces being disposed on said bearing shaft means to face in opposite directions from one another and defining a distance therebetween;

said means for adjusting comprises a passage therethrough, said passage of said means for adjusting comprising a first passage portion and at least two second passage portions;

said first passage portion being substantially circular with a diameter essentially equal to the diameter of said bearing shaft means;

said at least two second passage portions extend from said first passage portion, and each of said at least two second passage portions comprise two substantially parallel flat surfaces disposed at a distance from one another, said distance between said two substantially parallel surfaces of each of said at least two second passage portions corresponding to said distance between said two substantially parallel surfaces of said bearing shaft means;

said substantially parallel surfaces of one of said at least two second passage portions being disposed angularly with respect to said substantially parallel surfaces of others of said at least two second passage portions;

one of said at least two second passage portions corresponding to said first position of said means for adjusting, and another of said at least two second passage portions corresponding to said second position of said means for adjusting;

said means for non-rotationally mounting said means for adjusting to said bearing shaft means comprises said two substantially parallel surfaces of said bearing shaft means and said two substantially parallel surfaces of any of said at least two second passage portions;

said means for adjusting, with said first passage portion disposed about said bearing shaft means, being rotatable on said bearing shaft means to align said at least two parallel surfaces of one of said at least two second passage portions with said at least two parallel surfaces of said bearing shaft means;

said means for adjusting being slidable in a direction parallel to said aligned parallel surfaces to lock said means for adjusting in one of said first and second position;

said bearing shaft means comprises a first shaft portion and a second shaft portion;

said first shaft portion comprises said first end of said bearing shaft means, and said first shaft portion being non-rotationally fixed within said printer;

said second shaft portion comprises said second end of said bearing shaft means, said second shaft portion comprises said two substantially parallel surfaces of said bearing shaft means, and said second shaft portion being rotatable with respect to said first shaft portion for variably positioning said two substantially parallel surfaces;

said bearing shaft means further comprises means for non-rotationally fastening said second shaft portion to said first shaft portion for fixing said two substantially parallel surfaces in a predetermined position with respect to said first shaft portion;

said means for adjusting comprises a substantially planar element, said means for locking comprises at least first and second projections extending substantially perpendicularly from said planar element, each of said at least two second passage portions having a corresponding one of said at least first and second projections associated therewith, said planar element defining a plane, and said planar element for being positioned on said bearing shaft means with said plane thereof substantially perpendicular to said longitudinal axis of said bearing shaft means, and with said projections disposed substantially parallel to said longitudinal axis of said bearing shaft means;

said second cylindrical portion has a first end adjacent said first end of said bearing shaft means and a second end adjacent said second end of said bearing shaft means, said second end comprises a notch for receiving said projections of said planar element therein for locking said second cylindrical portion with said planar element;

said two substantially parallel surfaces of each of said at least two second passage portions define a longitudinal central axis therebetween;

said projection corresponding to one of said second passage portions being disposed in alignment with said longitudinal central axis of said one of said second passage portions;

said projection corresponding to another of said second passage portions being disposed offset from said longitudinal central axis of said another of said second passage portions, said offset being in a direction towards said print head to reduce the distance between said first arm portion and said second arm portion;

said second cylindrical portion comprises a longitudinal projection extending radially away from said second cylindrical portion;

said longitudinal projection comprises said notch for engaging said projections of said means for adjusting;

said longitudinal projection comprises a first edge disposed towards said second arm portion;

said second cylindrical portion is pivotable about said bearing shaft means to pivot said second arm portion away from said pressure roller;

said projections of said means for adjusting being configured for engaging said first edge of said longitudinal projection upon pivoting of said second arm portion away from said pressure roller to retain said second arm portion pivoted away from said pressure roller;

said at least two second passage portions are disposed at about 90 degrees with respect to one another; and said projection corresponding to said one of said second passage portions and said projection corresponding to said another of said second passage portions being disposed at about 85 degrees with respect to one another.

19. The label printer according to claim 17, wherein:

said means for pivotably mounting said print head comprises a first cylindrical portion disposed about said bearing shaft means and a first arm portion extending away from said bearing shaft means; and said means for mounting said biasing means comprises a second cylindrical portion disposed about said first cylindrical portion of said means for pivotably mounting said print head and a second arm portion extending away from said bearing shaft means.

20. The label printer according to claim 19, wherein:

said biasing means comprising a compression spring disposed to be compressed between said first arm portion and said second arm portion;

said first position of said means for adjusting being for positioning said second arm portion at a first distance from said pressure roller to compress said biasing means a first amount between said first arm portion and said second arm portion;

said second position of said means for adjusting being for positioning said second arm portion at a second distance from said pressure roller to compress said biasing means a second amount between said first arm portion and said second arm portion; and said second distance being less than said first distance, wherein said second amount of compressing is greater than said first amount of compressing to provide said second biasing force greater than said first biasing force.

* * * * *

UNITED STATES PATENT AND TRADEMARK OFFICE

CERTIFICATE OF CORRECTION

PATENT NO. : 5,547,293

DATED : August 20, 1996

INVENTOR(S) : Ulf KOCH and Peter SCHNEIDER

It is certified that error appears in the above-indentified patent and that said Letters Patent is hereby corrected as shown below:

In column 1, line 65, after 'regard,', delete "An" and insert --in--.

In column 5, line 6, after 'somewhat', delete "ill" and insert --in--.

In column 8, line 15, after 'engaged', delete "An" and insert --in--.

In column 13, line 43, after 'can', delete "typically-be" and insert --typically be--.

In column 16, line 20, after 'ribbon', delete "4'." and insert --4'--.

In column 16, line 21, before the first occurrence of 'the', delete "An" and insert --in--.

In column 17, line 28, after 'is', delete "An" and insert --in--.

In column 18, line 61, after 'used.', delete " The' " and insert --The--.

In column 19, line 40, after 'corresponding', delete ".nk" and insert --ink--.

UNITED STATES PATENT AND TRADEMARK OFFICE

CERTIFICATE OF CORRECTION

PATENT NO. : 5,547,293
DATED : August 20, 1996
INVENTOR(S) : Ulf KOCH and Peter SCHNEIDER It is certified that error appears in the above-indentified patent and that said Letters Patent is hereby corrected as shown below:

In column 19, line 46, after 'a', delete "speeds" and insert --speed,--.

In column 24, line 44, Claim 4, after 'force' insert --greater than said first biasing force;--.

In column 24, lines 45-46, Claim 4, after 'diameter;' delete "greater than said first biasing force;".

In column 25, line 65, Claim 4, after the second occurrence of 'said' insert --planar element therein for locking said second cylindrical--.

In column 26, lines 1-2, Claim 4, after 'ment;' delete "planar element therein for locking said second cylindrical".

In column 30, line 41, Claim 8, after 'said', delete "second-passage" and insert --second passage--.

In column 38, line 16, Claim 17, after 'biasing', delete "mean" and insert --means--.

UNITED STATES PATENT AND TRADEMARK OFFICE

CERTIFICATE OF CORRECTION

PATENT NO. : 5,547,293

DATED : August 20, 1996

INVENTOR(S) : Ulf KOCH and Peter SCHNEIDER

It is certified that error appears in the above-indentified patent and that said Letters Patent is hereby corrected as shown below:

In column 40, lines 7-8, Claim 18, after 'second', delete "position;" and insert --positions;--.

Signed and Sealed this

Eighteenth Day of February, 1997

*Attest:*

*Attesting Officer*

Bruce Lehman

BRUCE LEHMAN

*Commissioner of Patents and Trademarks*